US007278484B2

(12) United States Patent
Vella et al.

(10) Patent No.: US 7,278,484 B2
(45) Date of Patent: Oct. 9, 2007

(54) TECHNIQUES AND SYSTEMS ASSOCIATED WITH PERFORATION AND THE INSTALLATION OF DOWNHOLE TOOLS

(75) Inventors: Mark Vella, Kingswells (GB); Joe C. Hromas, Sugar Land, TX (US); Bennie Gill, Fulshear, TX (US); Larry Grigar, East Bernard, TX (US); Steven W. Henderson, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/533,386

(22) Filed: Sep. 20, 2006

(65) Prior Publication Data

US 2007/0034375 A1 Feb. 15, 2007

Related U.S. Application Data

(62) Division of application No. 10/686,043, filed on Oct. 15, 2003, now Pat. No. 7,152,676.

(60) Provisional application No. 60/419,718, filed on Oct. 18, 2002.

(51) Int. Cl.
*E21B 43/00* (2006.01)

(52) U.S. Cl. ..... 166/298; 166/55.1; 175/4.6

(58) Field of Classification Search ..... 166/298, 166/55, 55.1; 175/4.6
See application file for complete search history.

(56) References Cited

U.S. PATENT DOCUMENTS

| | | | | |
|---|---|---|---|---|
| 3,627,066 | A * | 12/1971 | Johnson | 175/4.53 |
| 5,881,814 | A | 3/1999 | Mills | |
| 6,167,957 | B1 * | 1/2001 | Frazier | 166/55.2 |
| 6,679,327 | B2 * | 1/2004 | Sloan et al. | 166/297 |
| 2003/0230406 | A1 | 12/2003 | Lund | |
| 2004/0107825 | A1 | 6/2004 | Kash | |

FOREIGN PATENT DOCUMENTS

| | | | |
|---|---|---|---|
| EP | 0288237 | A2 | 10/1988 |
| EP | 0628699 | A1 | 12/1994 |
| GB | 2397594 | A | 7/2004 |

* cited by examiner

*Primary Examiner*—William P Neuder
(74) *Attorney, Agent, or Firm*—Fred G. Pruner; Kevin B. McGoff; Bryan P. Galloway

(57) ABSTRACT

A technique to install a tool in a well includes running the tool into the well and fixing the tool to the well with a fixing agent without pumping the fixing agent through a central passageway of the tool. The tool may be a perforating gun that includes a casing body that includes a longitudinal axis. The perforating gun may also include a fin and a perforating charge. The fin radially extends from the casing body, and the perforating charge is attached to the fin and is oriented to generate a perforation jet in a radial direction away from the longitudinal axis of the casing body.

37 Claims, 26 Drawing Sheets

10
16
12
14

18
20

28
24
26
22
26
23

19
30

26
14
20

10
16
12
14

20
32

22
23
32

20
26

26
31
32

10
12
18
20
16
20
34
30
20
36
38
30
14

10
16
12
38
39
38
30
23
20
39
38
30

10
16
22
40
12
30
40
20
44
42
30
39
14
39
39
38
36
39
30

TECHNIQUES AND SYSTEMS ASSOCIATED WITH PERFORATION AND THE INSTALLATION OF DOWNHOLE TOOLS

This is a divisional of U.S. Ser. No. 10/686,043, filed Oct. 15, 2003 now U.S. Pat. No. 7,152,676 which claims priority to U.S. Provisional Patent Application Ser. No. 60/419,718, filed on Oct. 18, 2002.

BACKGROUND

The invention generally relates to systems and techniques associated with perforation and the installation of downhole tools.

A typical subterranean well includes a casing string that lines a wellbore of the well. To install the casing string, the string is first run into the well, and then the string is cemented in place. The cementing typically includes pumping a cement flow into a central passageway of the casing string. A mud flow is then communicated through the central passageway of the casing string behind the cement flow to displace the cement from inside the string and force the cement from the end of the string into the annulus.

One or more downhole tools may be integrated with the casing string so that these tools are installed with the string. Thus, the casing string may include one or more casing conveyed tools, such as perforating guns and/or formation isolation valves. A potential challenge relating to the use of the casing conveyed tools is that the above-described cementing technique may leave set cement inside the casing string, and this set cement may interfere with the proper functioning of the tools.

Casing conveyed tools may restrict the usable interior space of the casing string, making it difficult to potentially run other tools and strings inside the casing string. Casing conveyed tools may require one or more subsequent runs (after their installation) into the well for purposes of operating these tools.

Thus, there is a continuing need for systems and/or techniques to address one or more of the problems that are set forth above. There is also a continuing need for systems and/or techniques to address other problems that are not set forth above.

SUMMARY

In an embodiment of the invention, a method to install a tool in a well includes running the tool into the well and fixing the tool to the well with a fixing agent without pumping the fixing agent through a central passageway of the tool.

In another embodiment of the invention, a perforating gun includes a casing body, a fin and a perforating charge. The casing body includes a longitudinal axis, and the fin radially extends from the casing body. The perforating charge is attached to the fin and is oriented to generate a perforation jet in a radial direction away from the longitudinal axis of the casing body.

Advantages and other features of the invention will become apparent from the following description, drawing and claims.

DETAILED DESCRIPTION

Figure 1:
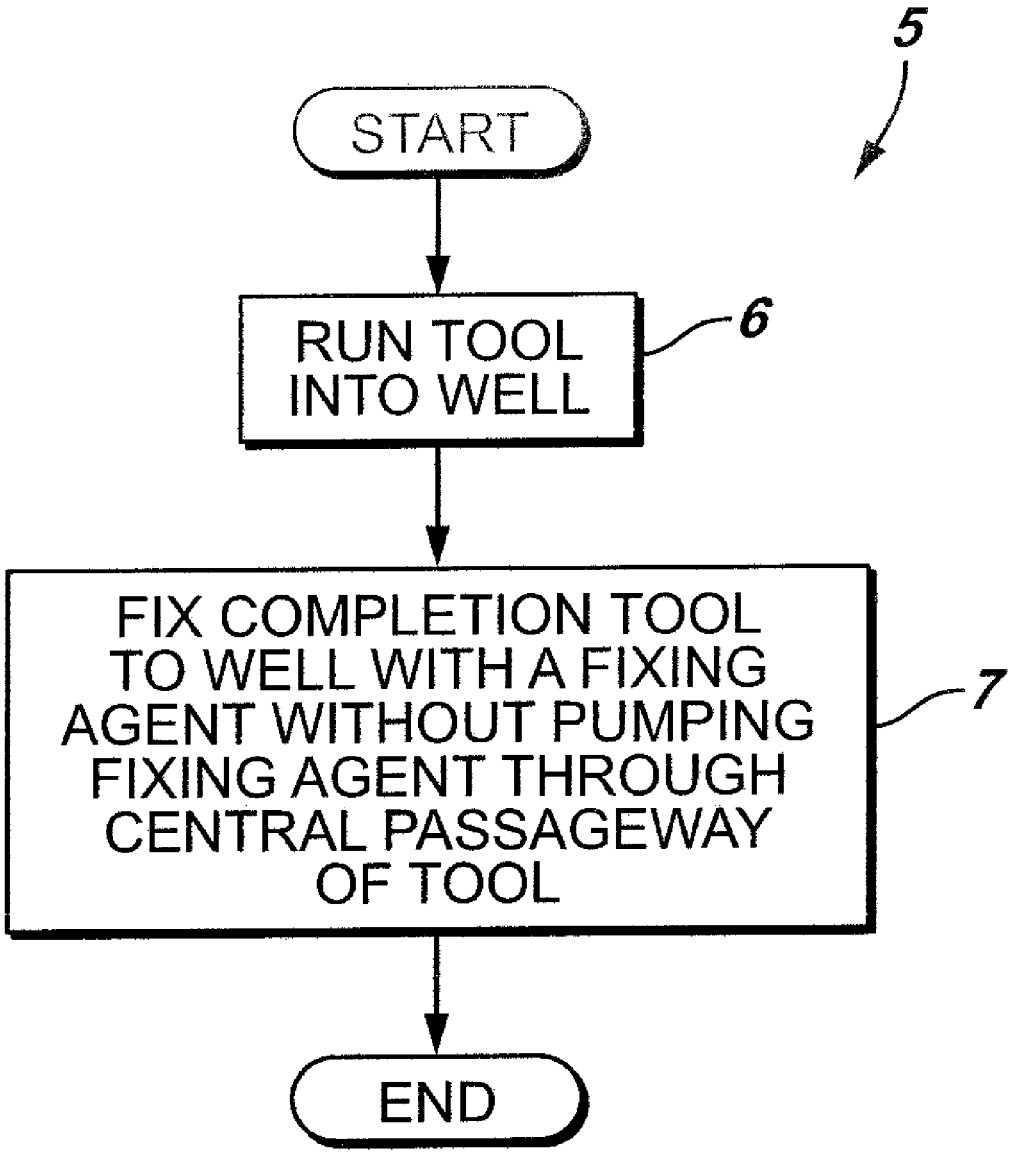
FIG. 1 is a flow diagram depicting a technique to install a casing conveyed tool in a subterranean well according to an embodiment of the invention.

Referring to FIG. 1, an embodiment 5 of a technique in accordance with the invention may be used to install a tool in a subterranean well with a fixing agent (cement, for example) in a manner that does not leave remnants of the fixing agent that might interfere with future operation of the tool. More specifically, the technique 5 includes running (block 6) a tool into the well and then fixing (block 7) the tool to the well with a fixing agent without pumping the fixing agent through a central passageway of the tool. Thus, due to the isolation of the fixing agent from the central passageway of the tool, no set fixing agent is present in the central passageway after the tool is installed. It is noted that in some embodiments of the invention, block 7 of FIG. 1 may be performed before block 6.

In some embodiments of the invention, the tool may be a casing conveyed tool, a tool that is connected to and is installed with a casing string section as a unit. Thus, the casing conveyed tool becomes part of the installed casing string. In some embodiments of the invention, the tool may also be a completion tool, such as a formation isolation valve or a perforating gun. A casing conveyed tool is described below in connection with various embodiments of the invention. However, other tools may be used in other embodiments of the invention.

Figures 2A, 2B, 2C, 2D, 2E, 2F:
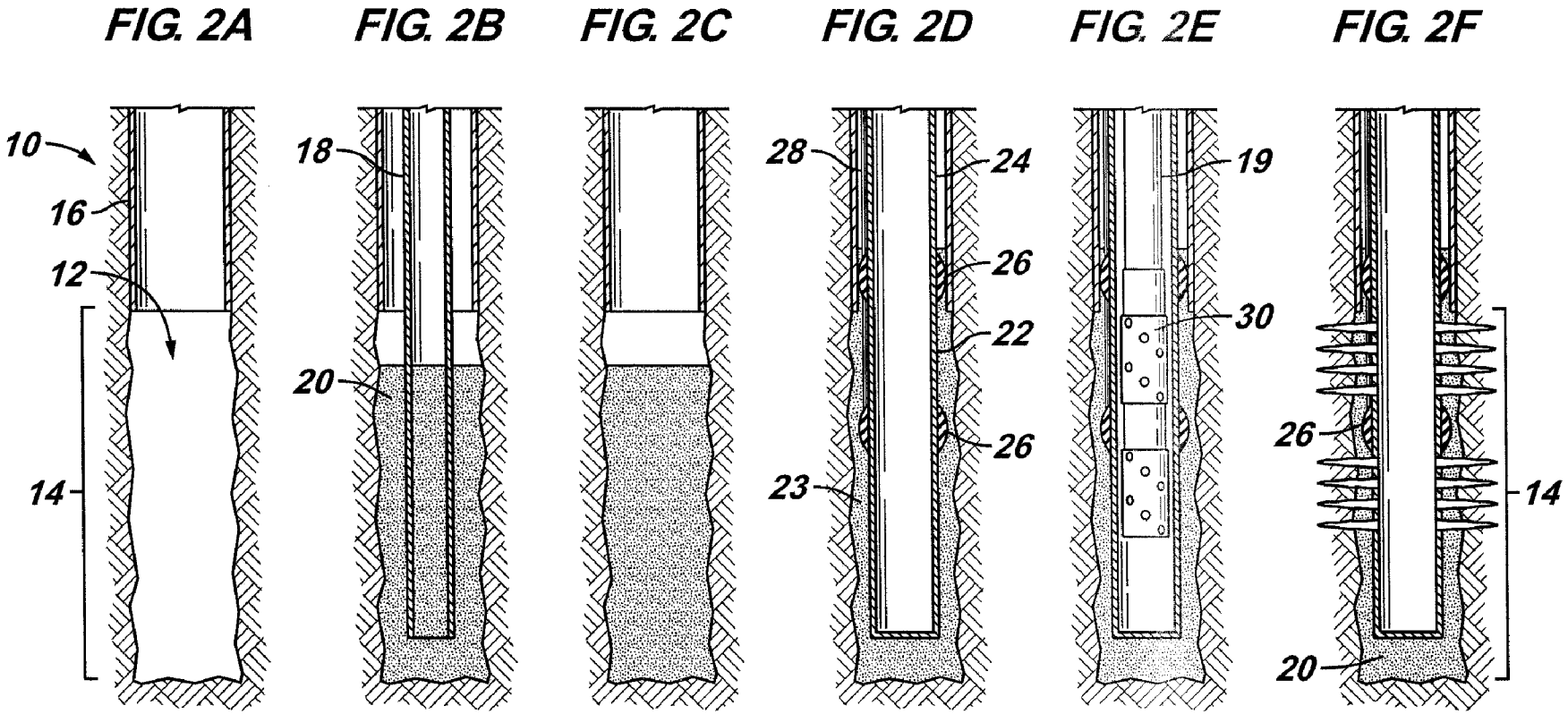
FIGS. 2A, 2B, 2C, 2D, 2E and 2F are schematic views of a well in different stages during the installation of a casing conveyed tool according to an embodiment of the invention.

FIGS. 2A-2F depict different stages of a well during the installation of a casing conveyed tool in accordance with the technique 5. FIG. 2A shows a well 10 having an open hole 12 in a zone of interest 14. The well 10 may be open or have an upper casing 16 above the zone 14. The well 10 may be generally filled with drilling fluid ("mud") to counter wellbore pressures.

In FIG. 2B, a work string 18 is run into the well 10. An appropriate volume of a fixing agent, such as cement 20, is pumped through the central passageway of the work string 18 into the zone 14. The work string 18 is then removed from well 10, as depicted in FIG. 2C. In some embodiments of the invention, the cement 20 may have retarding agents to regulate the rate at which cement 20 sets or hardens. Before the cement 20 hardens, a casing conveyed tool 22 is run into well 10, as shown in FIG. 2D. The tool 22 is closed or plugged at its bottom end so no fluid enters the central passageway of the tool 22 from below. As the tool 22 is lowered into the cement 20, the cement 20 is displaced up around the outside of the tool 22, into the annulus 23 between the tool 22 and the wall of the well 10. The cement 20 is allowed to set around the tool 22, securing the tool 22 in place in the well 10.

As depicted in FIGS. 2A-2F, the casing conveyed completion tool 22, in some embodiments of the invention, may include a casing string section 24, formation isolation valves 26 and a control line 28 that are integrally attached thereto. Other embodiments are possible for the tool 20. In general, in some embodiments of the invention, the tool 22 includes a casing section 24 and some other downhole apparatus, such as perforators or valves, and perhaps control lines, integrally combined and run into well 10 with the casing 24 as a unit. These combinations are for illustrative purposes only, and the invention is not limited to just those combinations described.

After the tool 22 is fixed in the well 10, perforating guns 30 may be lowered downhole on a work string 19 (or some other transport device such as coiled tubing, a slickline or a wireline) and positioned to perforate the casing 24 and the zone 14, as depicted in FIG. 2E. The guns 30 may be repositioned and oriented, if necessary, to avoid damaging the valves 26 and the control line 28. After the positioning of the guns, the guns 30 may then be fired and removed from well 10, as depicted in FIG. 2F. The guns 30 may be fired separately for each particular stratum of interest in zone 14, or the guns 30 may be fired all at once. If desired, the valves 26 may be operated to isolate the lowermost or both portions of zone 14 from the portion of well 10 upstream of the particular valve 26 that is closed.

Figure 3:
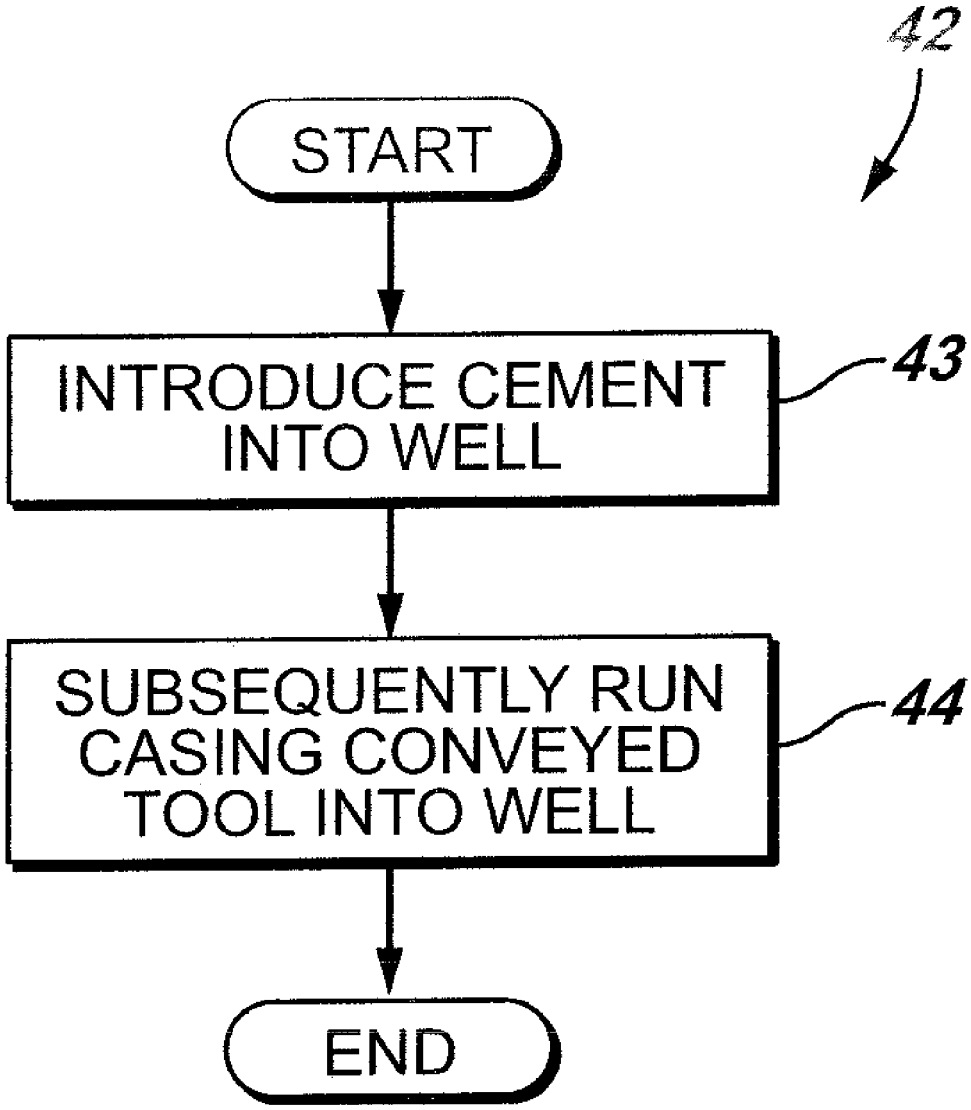
FIG. 3 is a flow diagram illustrating the technique depicted in FIGS. 2A, 2B, 2C, 2D, 2E and 2F according to an embodiment of the invention.
Figure 4A:
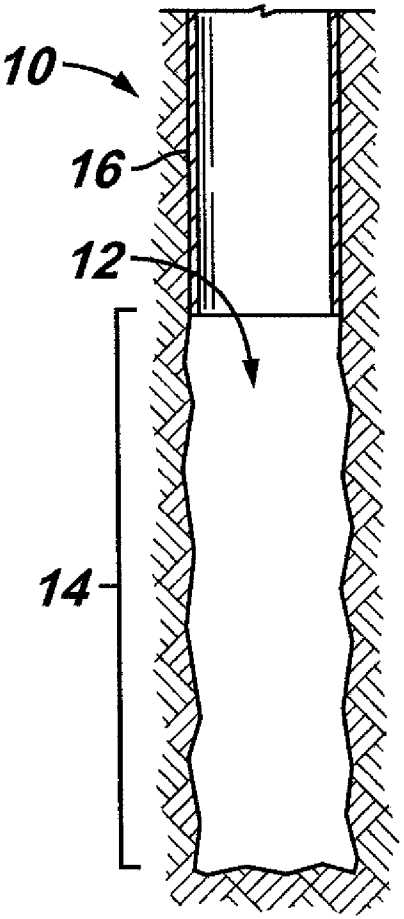
FIGS. 4A, 4B, 4C and 4D are schematic views of a well in different stages during the installation of a casing conveyed tool according to an embodiment of the invention.
Figure 4B:
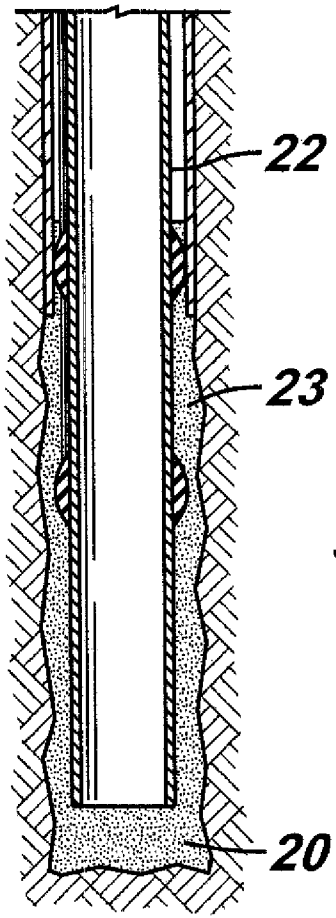
Figure 4C:
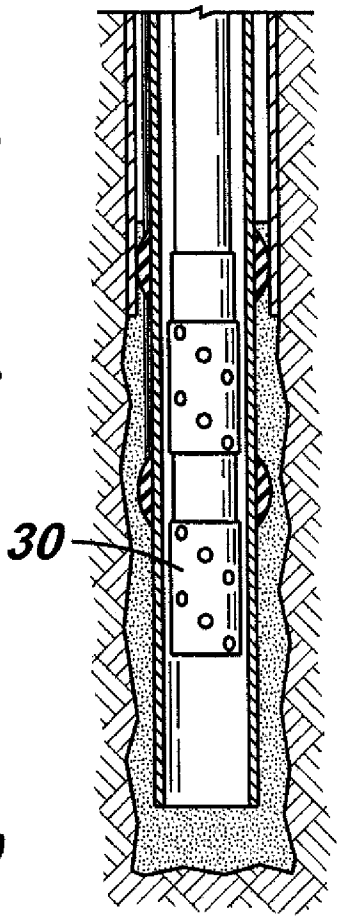
Figure 4D:
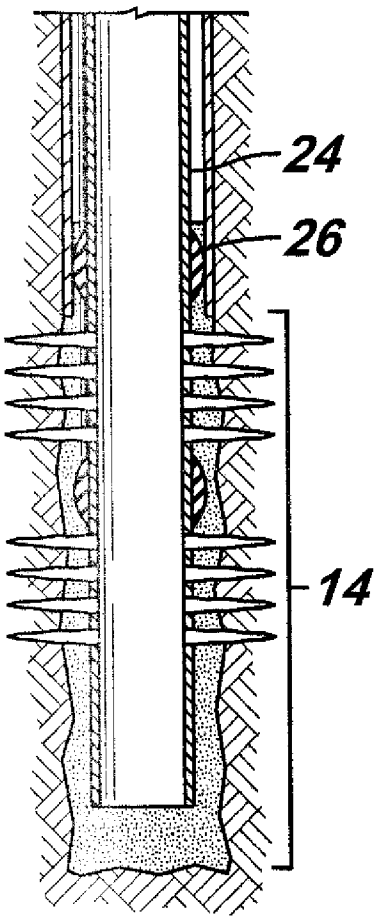

Thus, FIGS. 2A-2F generally describe a technique 42 (see FIG. 3) to install a casing conveyed tool in cement. Referring to FIG. 3, this technique 42 includes introducing (block 42) cement into the well, and subsequently running (block 44) the casing conveyed completion tool into the well so that the cement sets around the tool to fix the tool in place.

FIGS. 4A-4D depict stages of a well 10 in accordance with another embodiment of the technique 5. FIGS. 4A-4D show the well 10, the open hole 12, the zone 14 and the upper casing 16. In this embodiment, however, the tool 22 is run into well 10 prior to the cement 20 being placed. The tool 22 is plugged at its bottom or entry into the interior passageway of the tool 22 from below is otherwise blocked. Once tool 22 is properly positioned, the cement 20 is pumped into annulus 23 from above. This is sometimes referred to as reverse circulation. Once the appropriate amount of the cement 20 is pumped, based on annulus volume, the cement 20 is allowed to harden around tool 22, setting it in place in well 10.

After tool 22 is set in place, guns 30 can be lowered into place, fired, and removed. As described before, guns 30 can be fired for individual portions of zone 14 or fired all at once for the entire zone. If the tool 22 includes formation isolation valves, whether of flapper type, ball type, or some other type, different portions of the zone 14 may be treated individually, or a lower portion can be isolated to stop production from that lower portion. Though not expressly shown in these FIGS. 2A-2F or FIGS. 4A-4D, the tool 22 may include have casing conveyed perforators, thereby eliminating the need to transport the guns 30 in a separate run.

Figure 5:
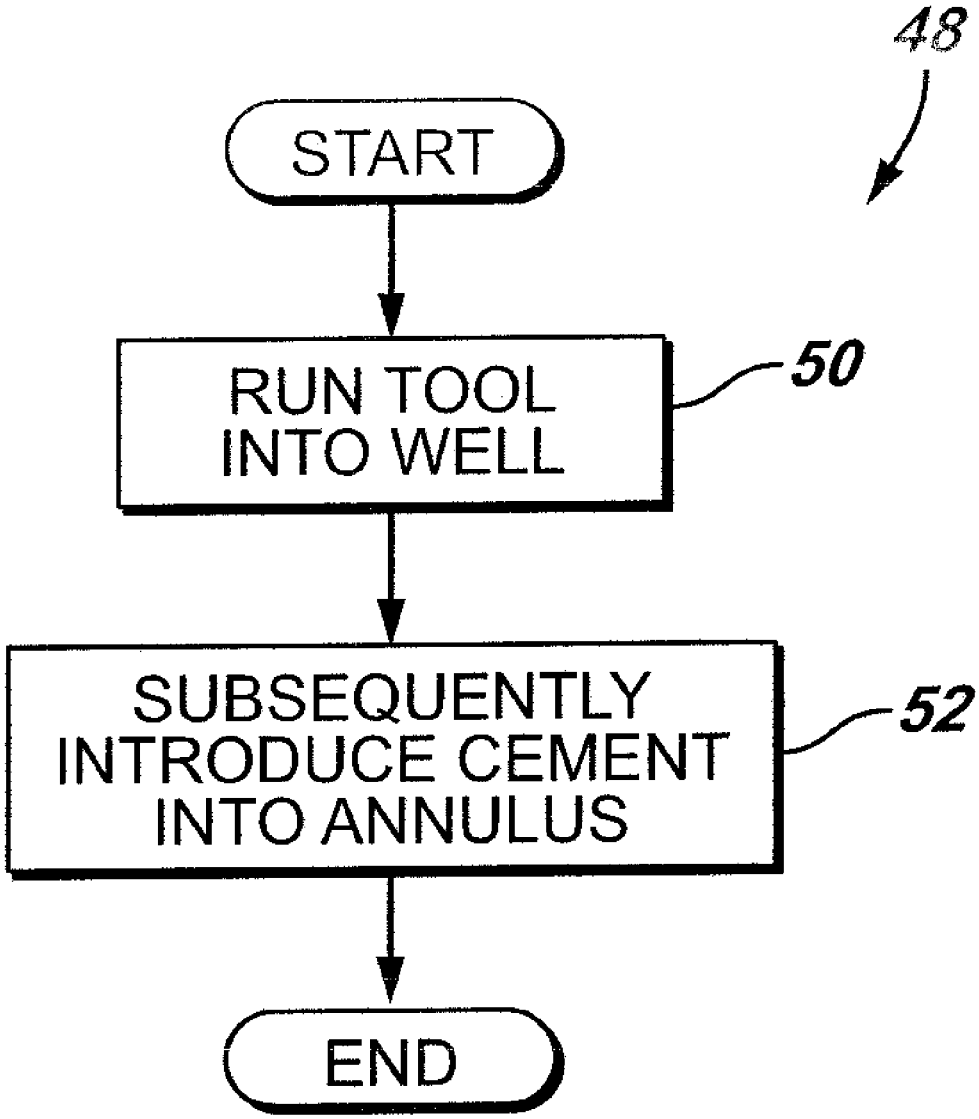
FIG. 5 is a flow diagram illustrating the technique depicted in FIGS. 4A, 4B, 4C and 4D according to an embodiment of the invention.

Thus, FIGS. 4A-4D depict a technique 48 that is depicted in FIG. 5. This technique 48 includes running (block 50) a tool into a well and subsequently introducing (block 52) cement into the annulus of the well to fix the tool in place.

A filter cake generally protects the formations in the zone 14 from damage from the cement 20. However, if those formations are particularly vulnerable to the rigors of cement being pumped through, one of the other embodiments described herein, such as the embodiments described in connection with FIGS. 2A-2F and 3, may be better suited for that situation.

Figures 6A, 6B, 6C, 6D, 6E:
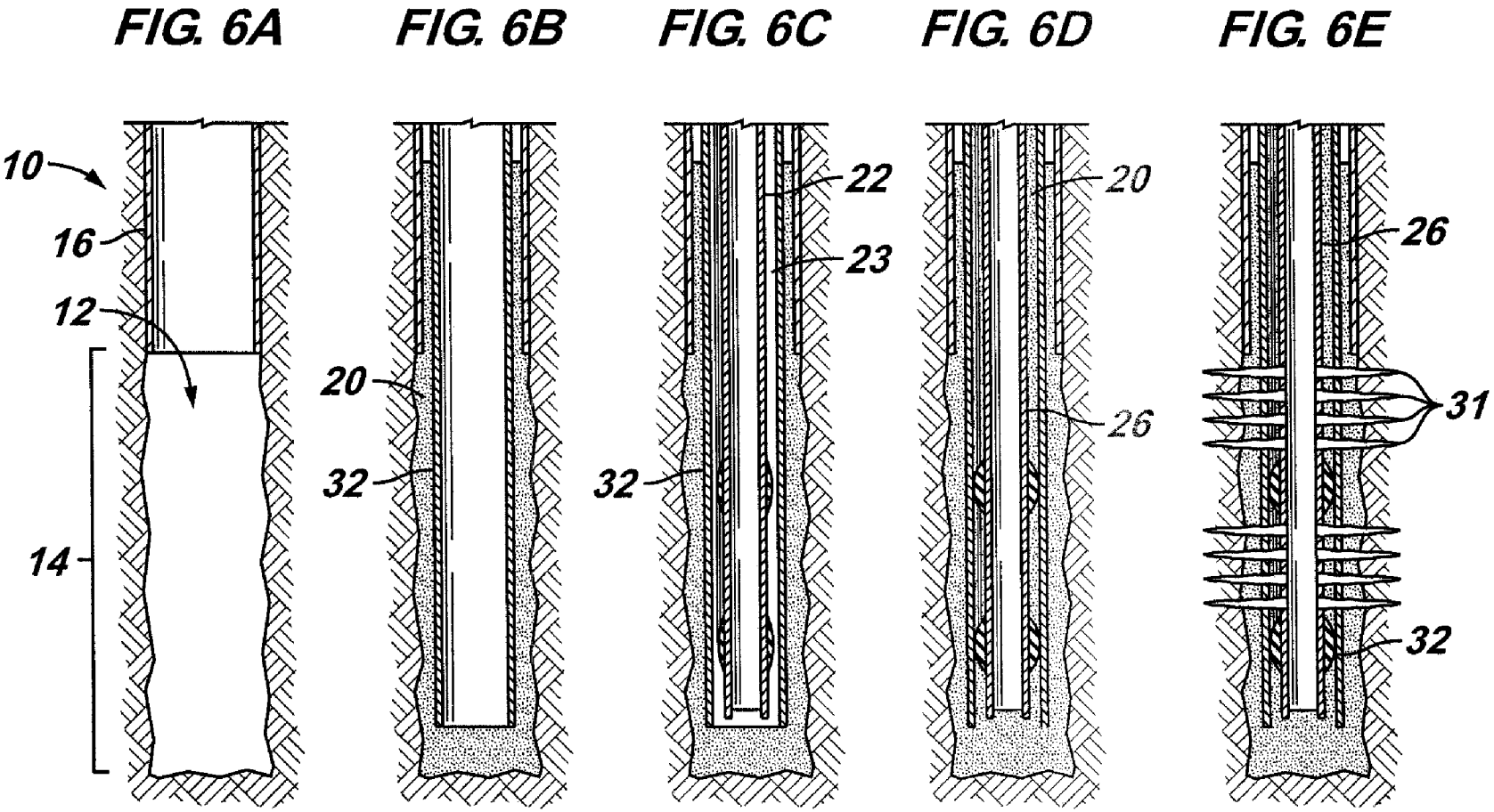
FIGS. 6A, 6B, 6C, 6D and 6E are schematic views of a well in different stages during the installation of a casing conveyed tool according to an embodiment of the invention.

FIGS. 6A-6E depict stages of a well 10 in accordance with another embodiment of the technique 5. In this embodiment, a well 10 includes the open hole 12, the zone 14, and the upper casing 16, as depicted in FIG. 6A. A conventional casing 32 is placed and set in well 10 by conventional means, as depicted in FIG. 6B. A tool 22 is then run in and placed within casing 32, as depicted in FIG. 6C. Thus, the outer diameter of a casing 26 of the tool 22 is less than the inner diameter of the casing 32, creating an annulus 23 between the tool 22 and the casing 32. Referring to FIG. 6D, cement 20 is pumped by reverse circulation into the annulus 23 to fix the tool 22 in place. Referring to FIG. 6E, once set in place, a housing 26 of tool 22 and the casing 32 are perforated. In the embodiment shown, the housing 26 conveys perforating charges to form the perforation tunnels 30, so a separate run downhole with a perforating gun is not required.

Figure 7:
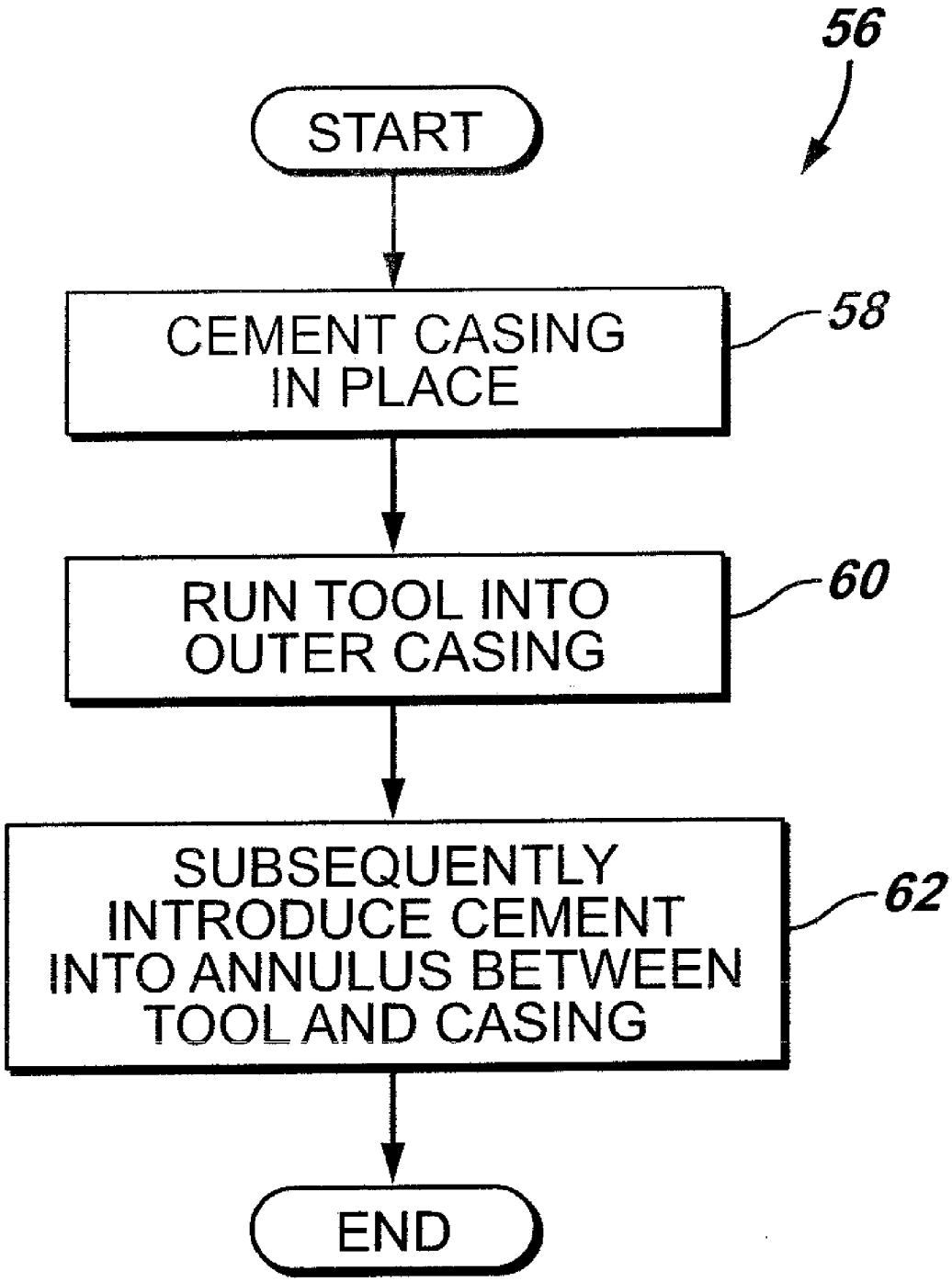
FIG. 7 is a flow diagram illustrating the technique depicted in FIGS. 6A, 6B, 6C, 6D and 6E according to an embodiment of the invention.
Figures 8A, 8B, 8C, 8D, 8E, 8F, 8G:
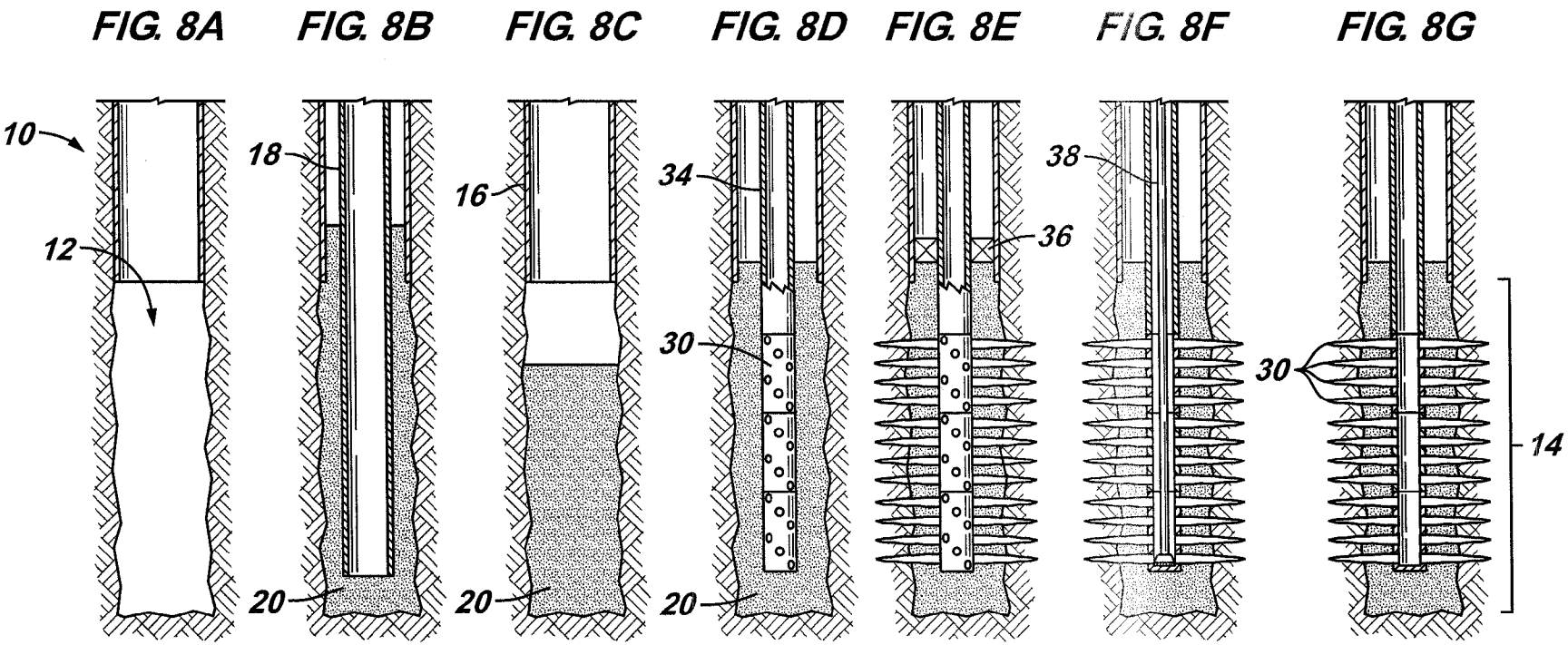
FIGS. 8A, 8B, 8C, 8D, 8E, 8F and 8G are schematic views of a well in different stages during the installation and firing of a perforating gun according to an embodiment of the invention.

Thus, FIGS. 6A-6E depict a technique 56 that is generally depicted in FIG. 7. This technique 56 includes cementing (block 58) a casing in place and running tool into the casing, as depicted in block 60. The technique 56 also includes subsequently introducing (block 62) cement into the annulus between the tool and the casing.

It may be desirable to run a perforating gun string into a well, cement the perforating gun string in place; and after firing of the guns of the string, using the tubular structure provided by the gun string to communicate production fluid from the formation. As a more specific example, FIGS. 8A-8G depict different states of a well and illustrate such a technique in accordance with an embodiment of the invention. In FIGS. 8A-8G, a work string 18 is run into the well 10, cement 20 (with retardants) is pumped through work string 18 into an open hole 12, and then the work string 18 is removed. Guns 30 (or a tool 22, having casing conveyed perforators 30) are lowered on production tubing 34 and run into the unset cement 20. The cement 20 is displaced up and around guns 30 (or tool 22), and the cement 20 is allowed to set. An optional packer 36 may be placed near the base of upper casing 16 or otherwise above zone 14. Once the cement 20 is set, the guns 30 are fired. Because guns 30 are fixed in place, however, they remain in place. To create an unobstructed passageway for production, the inside of guns 30 are cleaned out, for example, by milling with coiled tubing 38 and/or washing with acid. The internal components of guns 30 are or can be designed to be made from easily millable materials to facilitate this process. Once cleaned of internal debris, guns 30 serve as production casing.

Figure 9:
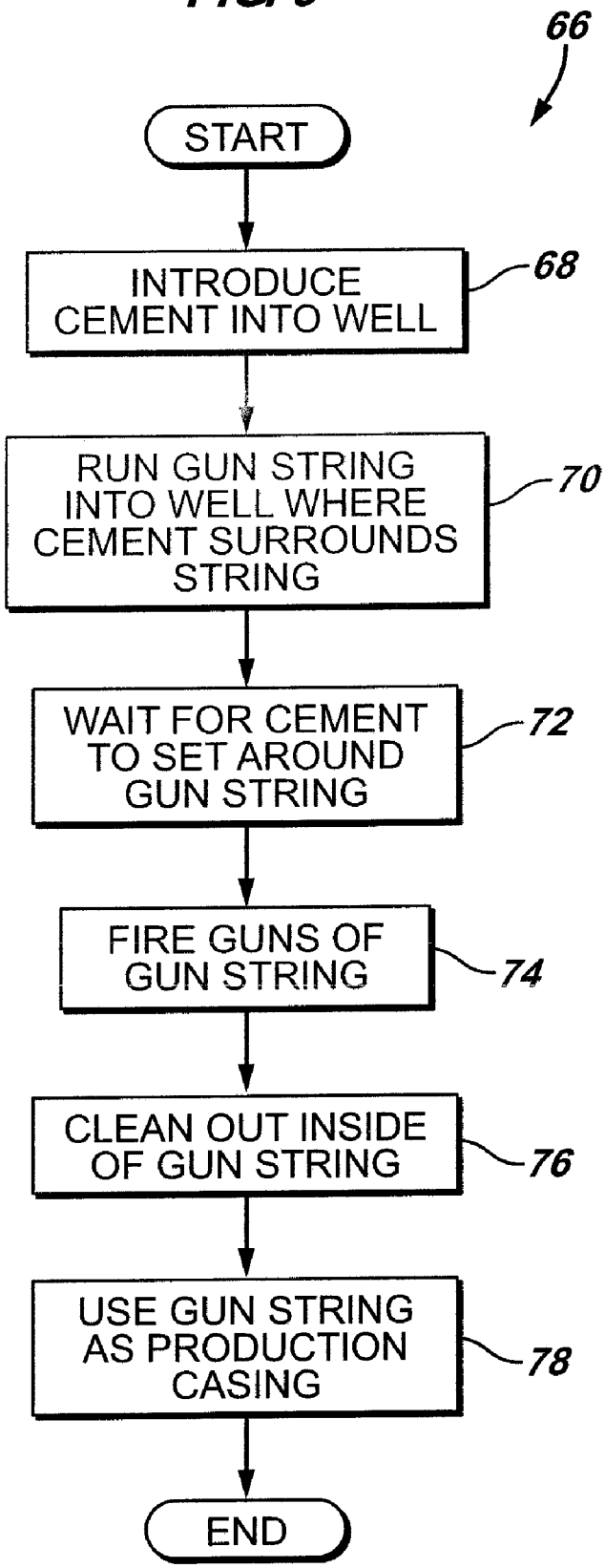
FIG. 9 is a flow diagram depicting the technique depicted in FIGS. 8A, 8B, 8C, 8D, 8E, 8F and 8G according to an embodiment of the invention.
Figures 10A, 10B, 10C, 10D, 10E, 10F:
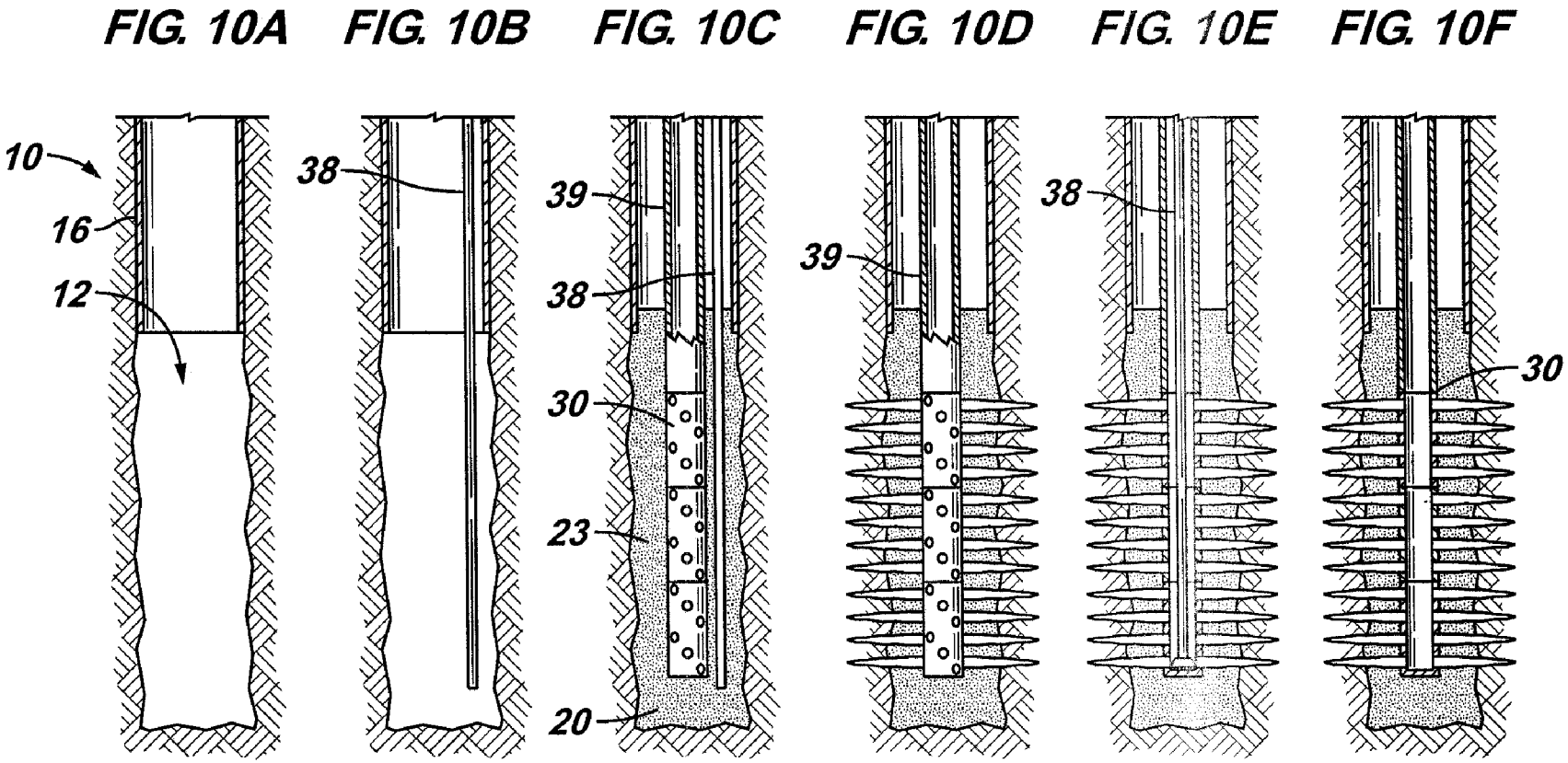
FIGS. 10A, 10B, 10C, 10D, 10E and 10F are schematic views of a well in different stages during the installation and firing of a perforating gun according to an embodiment of the invention.

Thus, in accordance with an embodiment of the invention, a technique 66 that is depicted in FIG. 9 may be used. In this technique 66, cement is introduced (block 68) into a well and a gun string is run (block 50) into the well where the cement surrounds the string. The gun string includes perforating charges near its lower end and is attached at its upper end to a production tubing. The technique 66 includes waiting (block 72) for cement to set around the gun string and firing (block 74) the guns of the gun string. Subsequently, the technique 66 includes cleaning out (block 76) the inside of the gun string and using (block 78) the gun string as a production tubing.

FIGS. 10A-10F depict a technique in accordance with another embodiment of the invention. More particularly, FIGS. 10A-10F show an embodiment in which coiled tubing 38 is run into well 10 down to open hole 12. Guns 30 (or tool 22) are then run in on production tubing 39 alongside the coiled tubing 38. The order of those operations may be reversed, if desired. Once both coiled tubing 38 and guns 30 (or tool 22) are properly positioned in open hole 12, cement 20 is pumped through tubing 38 into the annulus 23. After an appropriate amount of the cement 20 is pumped in place, the coiled tubing 38 may be removed, if desired, or left in place. After cement 20 sets, the guns 30 are fired. As described above, guns 30 can be cleaned out to serve as production casing.

Similarly, if tool 22 includes valves 26 and casing conveyed perforators 30, coiled tubing 38 may be deployed through the internal passageway of tool 22. A packer or other means can be used to prevent infiltration of fluids into tool 22 from below. Cement 20 may then be pumped through coiled tubing 38 into annulus 23. Once cement 20 is set, coiled tubing 38 can be removed, perforators 30 fired, and well 10 produced.

Figure 11:
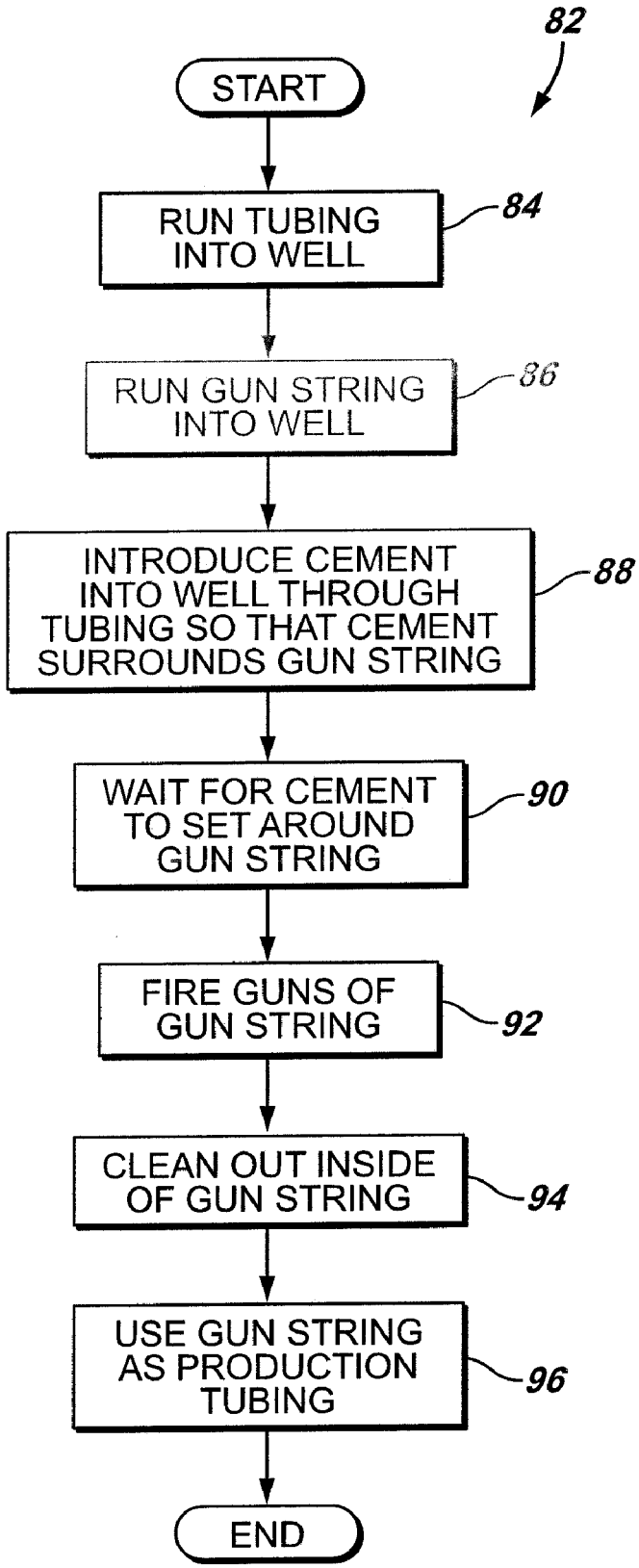
FIG. 11 is a flow diagram illustrating the technique shown in FIGS. 10A, 10B, 10C, 10D, 10E and 10F according to an embodiment of the invention.
Figures 12A, 12B, 12C, 12D, 12E:
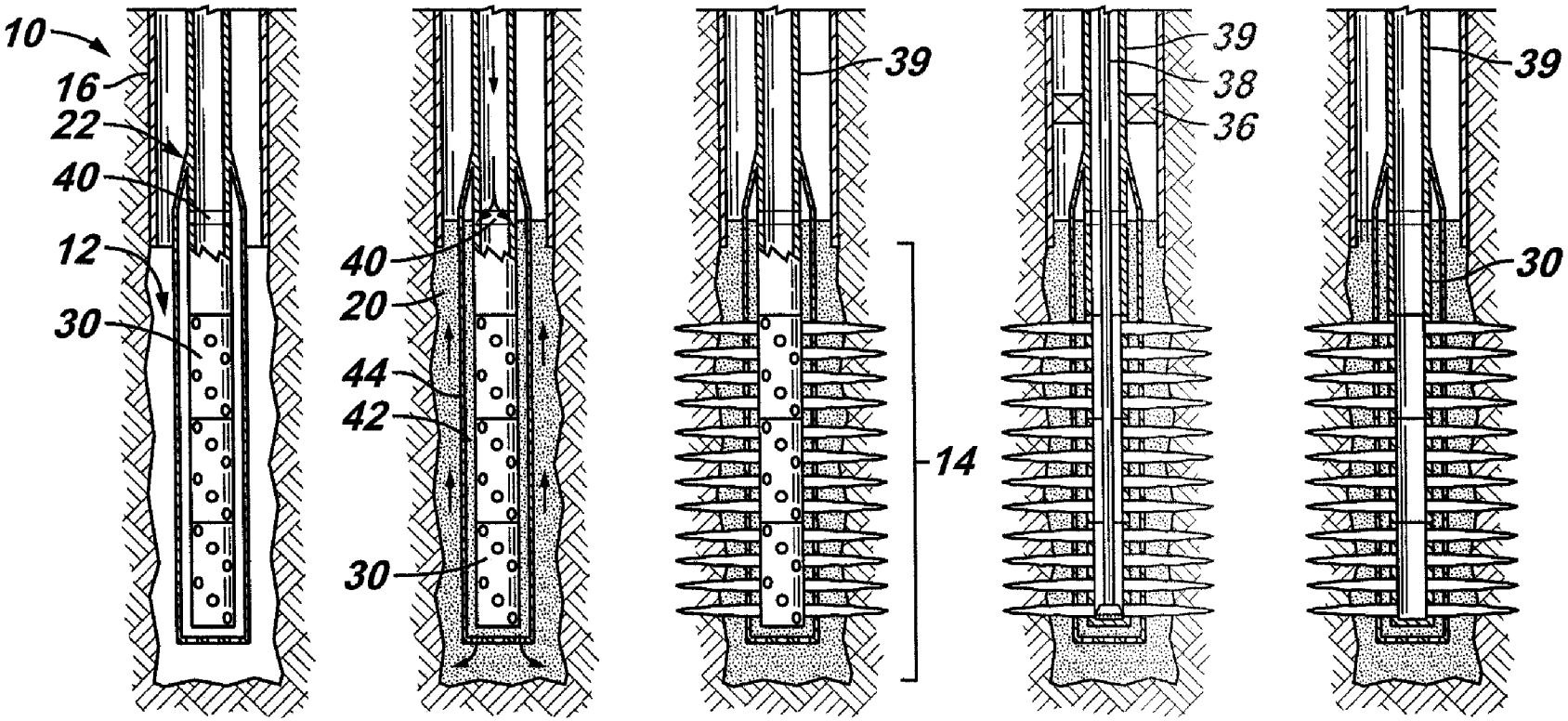
FIGS. 12A, 12B, 12C, 12D and 12E are schematic views of a well in different stages during the installation and firing of a perforating gun according to an embodiment of the invention.

Thus, a technique 82 that is generally depicted in FIG. 11 may be used to use a gun string as a production casing in some embodiments of the invention. In this technique 82, tubing is run (block 84) into a well and a gun string is run (block 86) into the well. Cement is introduced (block 88) into the well through the tubing so that the cement surrounds the gun string. Subsequently, the technique 82 includes waiting (block 90) for the cement to set around the gun string and then subsequently firing (block 92) the guns of the gun string. Next, the inside of the gun string is cleaned out, (as depicted in block 94.) Lastly, the technique 82 includes using (block 96) the gun string as a production tubing.

FIGS. 12A-12E depict another technique that may be used to cement a gun string in place in a subterranean well and subsequently use the gun string as a production tubing. More specifically, in the embodiment of FIGS. 12A-12E, the tool 22 includes perforating guns 30 and a crossover 40. An optional packer 36 may be placed near the base of the upper casing 16 or otherwise above the zone 14. The tool 22 is run into the open hole 12 on the production tubing 39, and cement 20 is pumped through tubing 39. When the cement 20 encounters the crossover 40, the cement 20 exits the interior passage way of tubing 39 and travels through inner annulus 42 formed by a sleeve 44 and guns 30. The cement 20 exits the bottom of tool 22 and flows upward around sleeve 44. After an appropriate amount of cement 20 is dispensed, pumping is stopped and the cement 20 is allowed to set. Guns 30 are then fired. The inside of guns 30 are cleaned out (as described above) and well 10 is produced using guns 30 as production casing.

Figure 13:
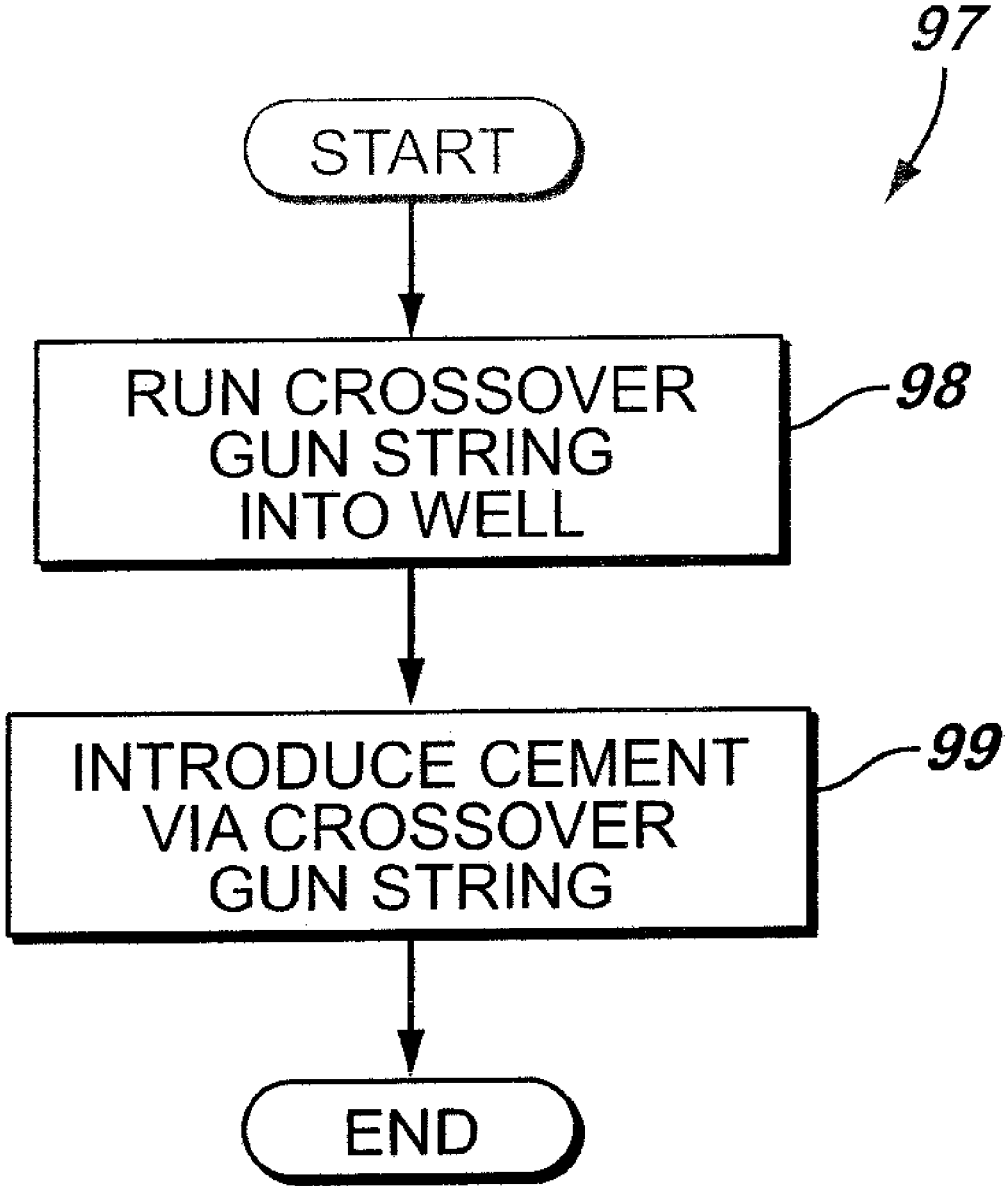
FIG. 13 is a flow diagram illustrating the technique depicted in FIGS. 12A, 12B, 12C, 12D and 12E according to an embodiment of the invention.

Thus, FIGS. 12A-12E depict another technique to use a gun string as a production casing. Referring to FIG. 13, this technique 97 includes running a crossover gun string into the well as depicted in block 98. Cement is then introduced (block 99) into the crossover gun string to submit the completion tool in place. As before, the cemented perforating gun string may be used as a production tubing after firing and cleaning out of the perforating gun string.

Figure 14:
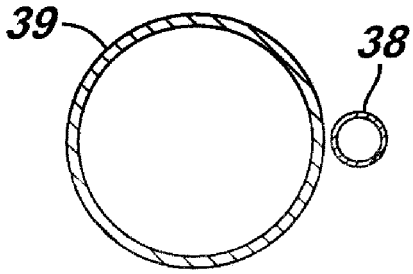
FIGS. 14, 15, 16 and 17 are cross-sectional views of a string and tubing according to different embodiments of the invention.
Figure 17:
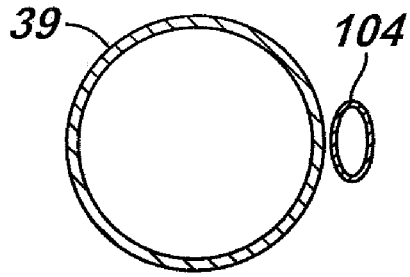
Figure 15:
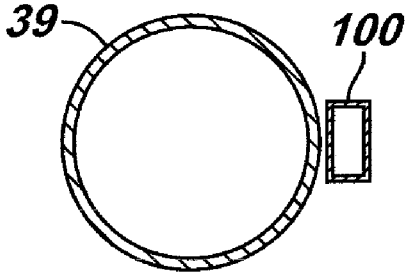
Figure 16:
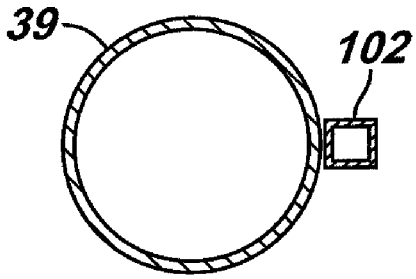

Many variations are within the scope of the following claims. For example, in the embodiment depicted in FIGS. 10A-10F, a coiled tubing 38 was described as being run downhole with a string 39 for purposes of introducing cement around the string 39. A possible cross-sectional view of the string 39 and the coiled tubing 38, in accordance with some embodiments of the invention, is depicted in FIG. 14. As shown, in these embodiments of the invention, the string 39 and coiled tubing 38 have circular cross-sections. In other embodiments of the invention, the coiled tubing may have a non-circular cross-sections. For example, FIG. 15 depicts a coiled tubing 100 that has a rectangular cross-section and may be used in connection with introducing cement around the string 39. As another example, FIG. 16 depicts a coiled tubing 102 that has a square cross-section and may be used for purposes of introducing cement around the string 39. As yet another example, FIG. 17 depicts a coiled tubing 104 that has an oval cross-section.

Figure 33:
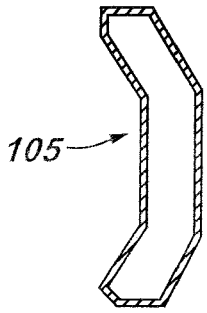
FIGS. 33, 34, 35 and 36 are cross-sections of a coiled tubing in accordance with different embodiments of the invention.
Figure 34:
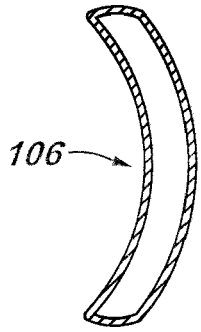
Figure 35:
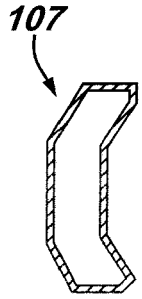
Figure 36:
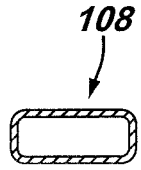
Figure 37:
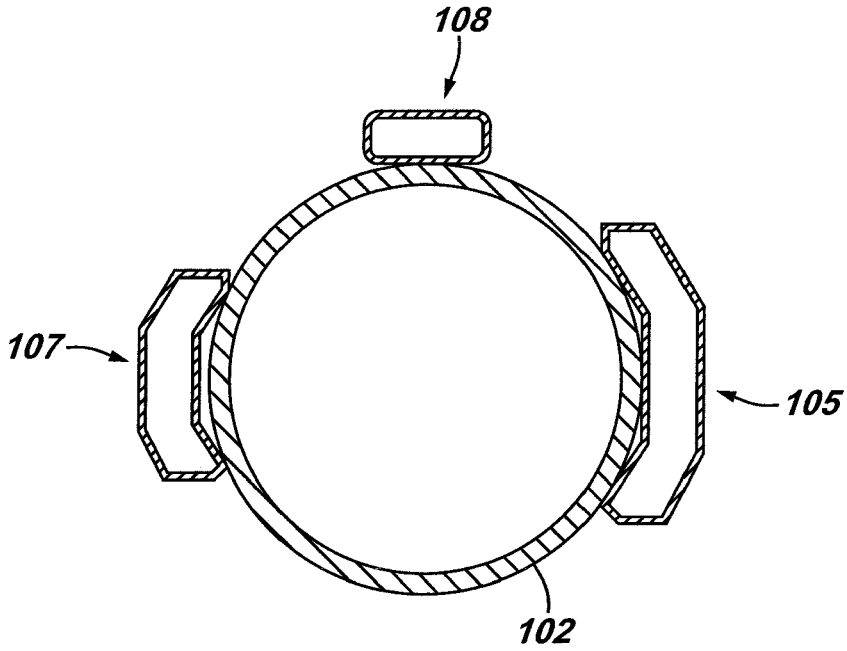
FIG. 37 is a cross-sectional view of a string and tubing according to an embodiment of the invention.

In some embodiments of the invention, the coiled tubing may have a cross-section that does not conform to a basic geometric shape. For example, FIGS. 33, 34 and 35 depict coiled tubings 105, 106 and 107, respectively, that are contoured to fit on the outer surface of the string 102. The coiled tubings 105, 106 and 107 may, for example, may be cementing tubes. FIG. 36 depicts another cross-section of a coiled tubing 108. As can be seen, this cross-section has rounded corners, and thus, represents a variation from a rectangular cross-section. FIG. 37 depicts an embodiment in which the coiled tubings 105, 107 and 108 are connected to the outside of the string 102. Thus, as can be seen, particular embodiments of the invention may include more than one coiled tubing alongside the string, as well as coiled tubings that have different cross-sections. Other variations are possible.

Although a single coiled tubing has been described in the embodiments above, other embodiments of the invention may include multiple coiled tubings that are run alongside the string 39 for purposes of introducing cement into the annulus. Furthermore, in some embodiments of the invention, one or more of these coiled tubings may communicate fluids (control fluids, for example) other than a fixing agent or cement.

Figure 19:
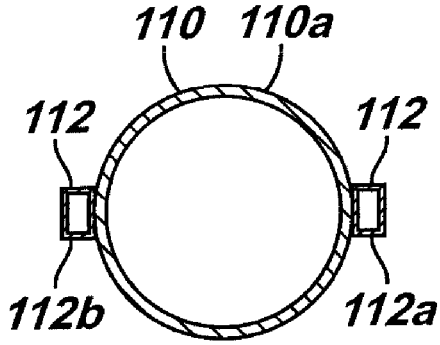
FIG. 19 is a cross-sectional view of the gun string taken along lines 19-19 of FIG. 18.
Figure 18:
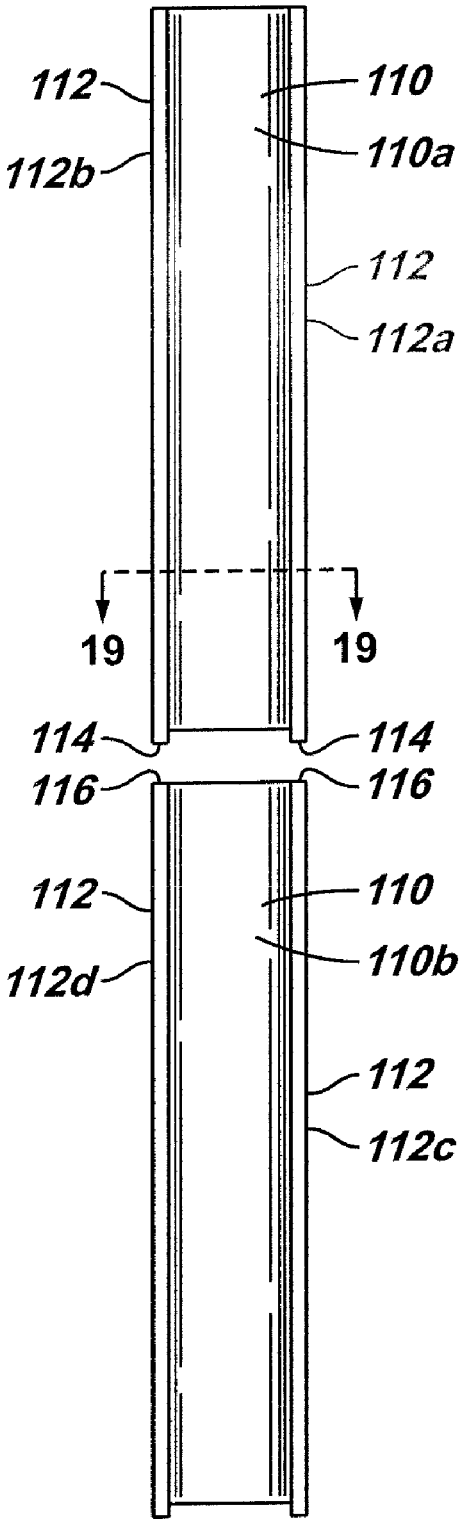
FIG. 18 is an exploded schematic view of a gun string according to an embodiment of the invention.

FIG. 18 depicts an embodiment in which multiple coiled tubings are connected to a particular work string. In this example, the work string is formed from sections 110, such as an upper section 110*a* and a lower section 110*b*. Each section 110, in turn, is connected to multiple coiled tubing sections that reside on the outside of the string section 110. For example, the tubing sections 112*a* and 112*b* are connected to the upper string section 110*a*, and the coiled tubing sections 112*c* and 112*d* that are connected to the lower work string section 110*b*. As depicted in FIG. 19, in some embodiments of the invention, the tubing sections 112 may have rectangular cross-sections.

Figure 20:
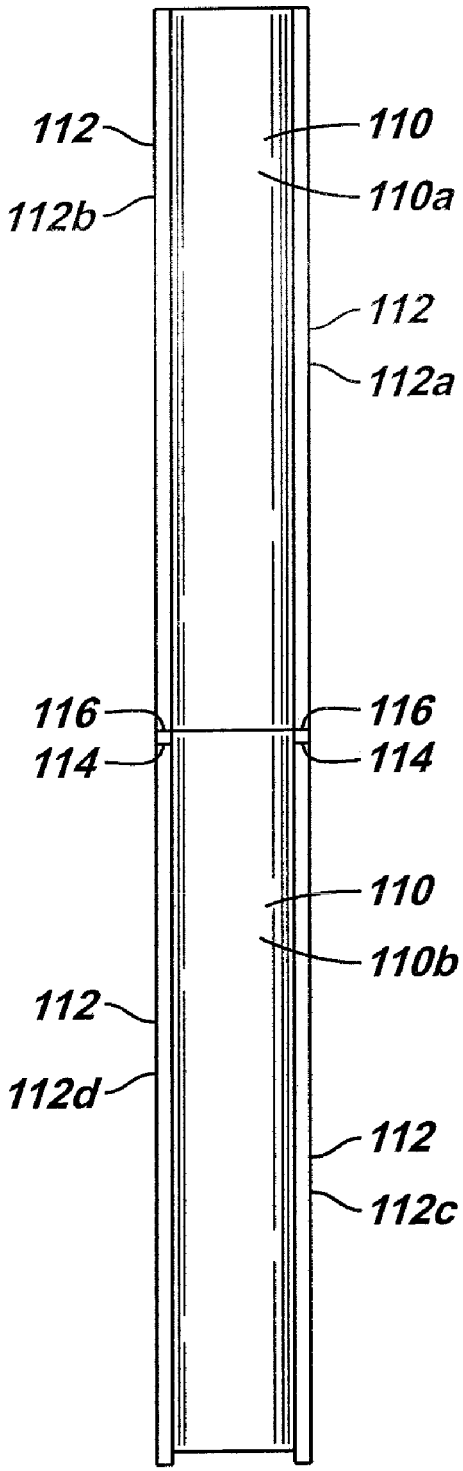
FIG. 20 is a schematic diagram of the perforating gun string when assembled according to an embodiment of the invention.

Referring to FIG. 20, when the sections are connected together, the upper work string section 110*a* is connected to the lower work string section 110*b*; the tubing section 112*b* connects to the tubing section 112*d*; and the tubing section 112*a* connects to the tubing section 112*c*.

Figure 21:
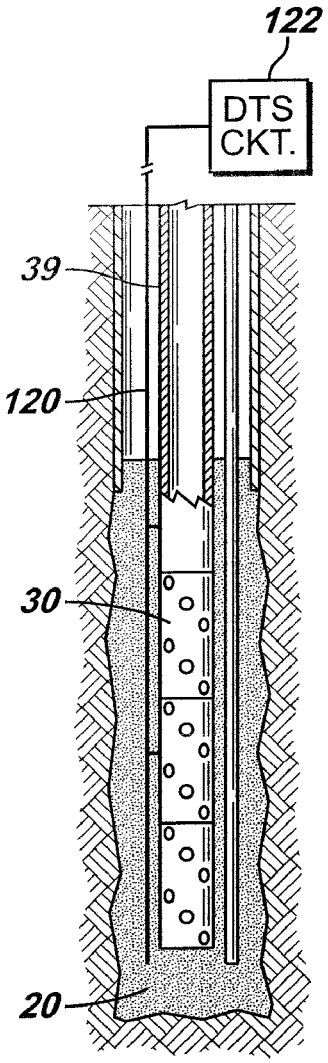
FIG. 21 is a schematic diagram of a perforating gun string installed in cement using an optical fiber according to an embodiment of the invention.

In some embodiments of the invention, sensors or other control lines may extend downhole with the work string. In this manner, in addition to or in replacement of the tubings discussed above, a sensor may be connected to a particular work string that is lowered downhole. This is depicted by way of example in FIG. 21. In this example, the work string 39 includes a perforating gun string with perforating guns 30. Also depicted in FIG. 1 is an optical fiber 120 that is lowered downhole with the string 39. The optical fiber 120 may be connected to a distributed temperature sensing (DTS) circuit 122 at the surface of the well. Due to this arrangement, the perforating gun string 39 and the attached optical fiber 120 may be lowered downhole at the same time. Cement or another fixing agent may then be communicated through the coiled tubing 38 to cement the string 39 in place. Due to the inclusion of the optical fiber 120, the flow of the cement may be monitored at the surface of the well.

Depending on the particular embodiment of the invention, the optical fiber 120 may be used to measure temperature and/or pressure before and/or after firing of the perforating guns. Depending on the particular embodiment of the invention, the optical fiber may allow monitoring of the cement curing and may also allow flow information to be acquired during the life of the well. Other variations are possible.

Figure 22:
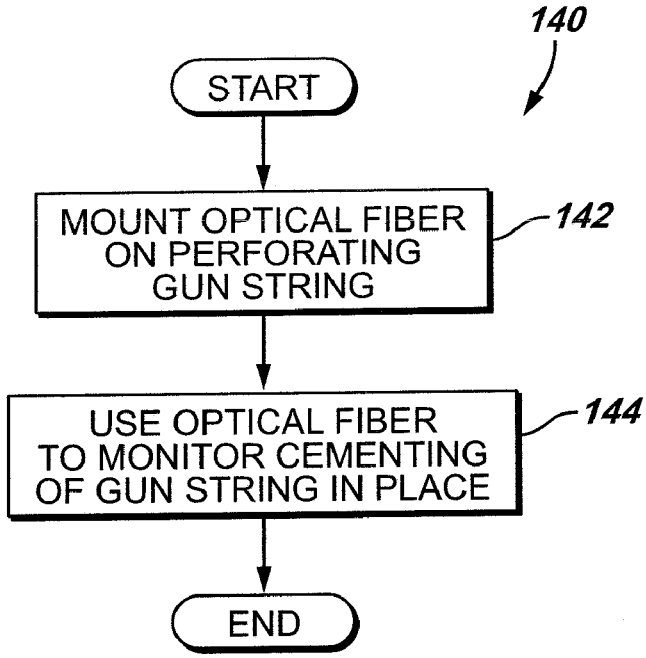
FIG. 22 is a flow diagram depicting a technique to use an optical fiber to monitor cementing of a tool according to an embodiment of the invention.

Referring to FIG. 22, in accordance with some embodiments of the invention, a technique 140 includes mounting (block 142) an optical fiber on a perforating gun string. The optical fiber is then used (block 144) to monitor the cementing of the gun string in place as well as to possibly monitor pressure and temperature conditions before and after firing of the gun string. Such a technique may be used to observe the cementing of other strings and other tools in other embodiments of the invention.

Figure 23:
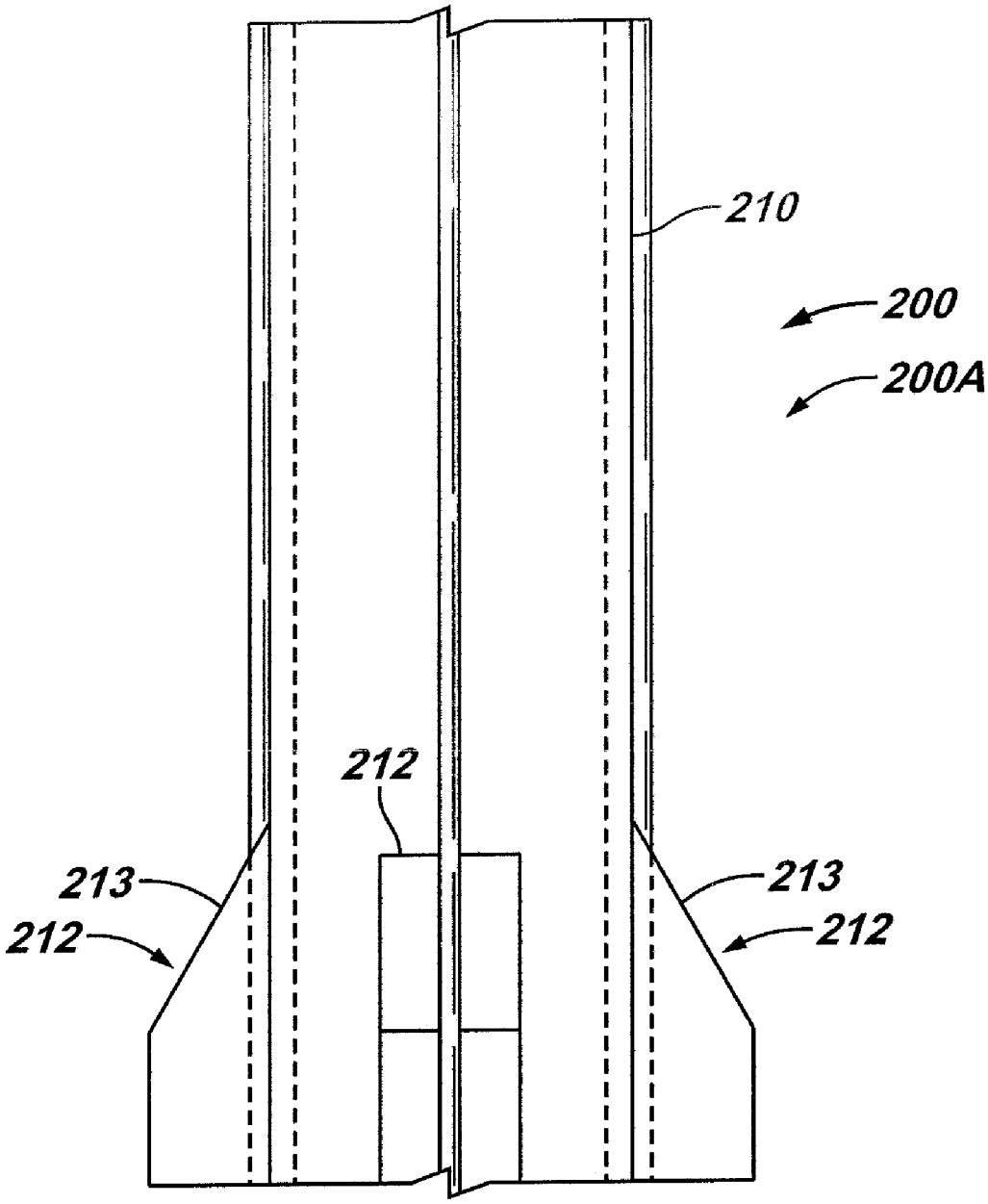
FIGS. 23, 24 and 25 depict a casing conveyed tool according to an embodiment of the invention.
Figure 24:
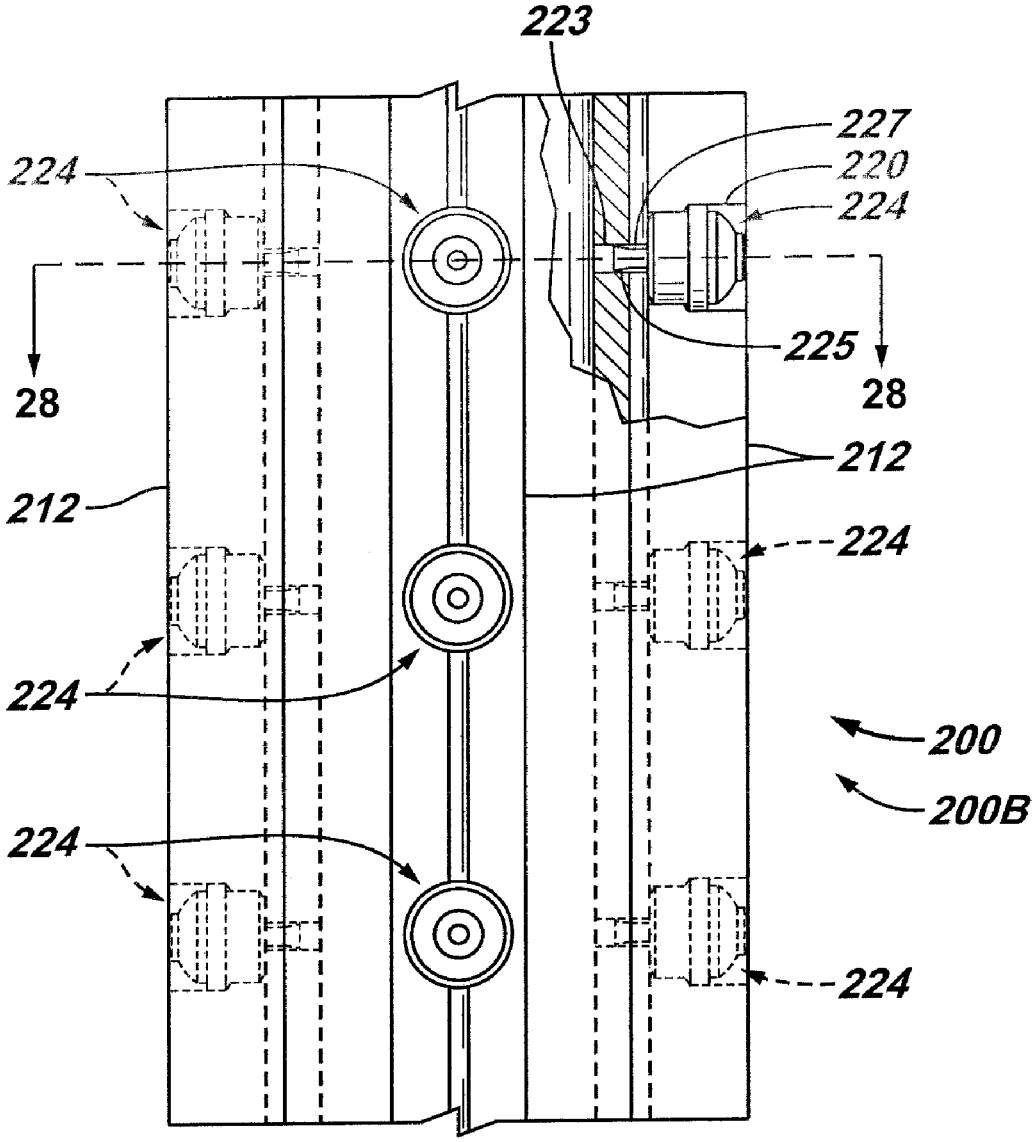
Figure 25:
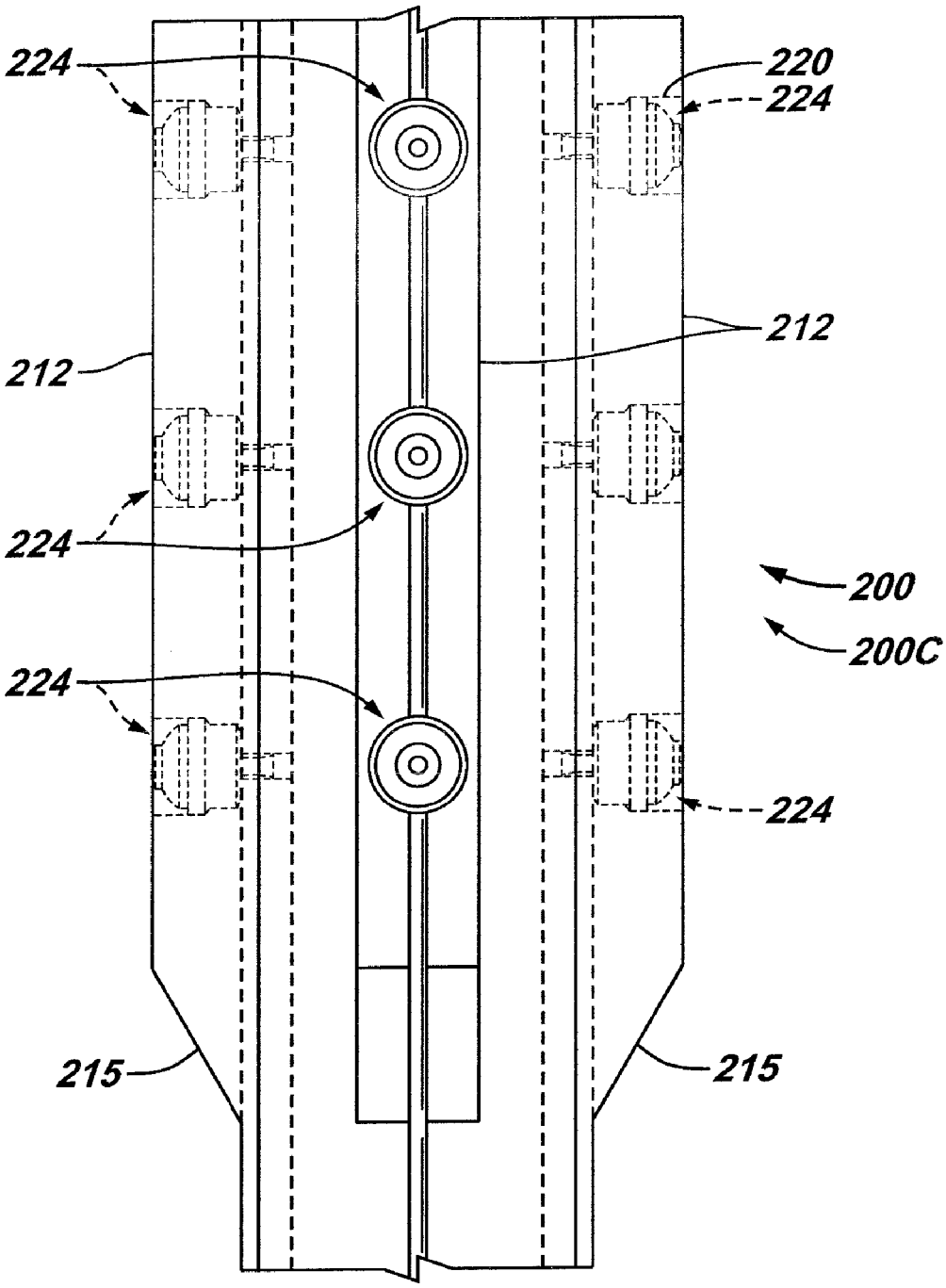

In accordance with some embodiments of the invention, FIGS. 23, 24 and 25 depict upper 200A, middle 200B and lower 200C sections, respectively, of a casing conveyed perforating tool 200. In some embodiments of the invention, the tool 200 includes a main casing body 210 that is generally a cylindrically shaped body with a central passageway therethrough. In some embodiments of the invention, the main casing body 210 may include threads (not shown) at its upper end for purposes of connecting the tool 200 to an adjacent upper casing section or another casing conveyed perforating tool. The main casing body 210 may include threads (not shown) at its lower end for purposes of connecting the tool 200 to an adjacent lower casing section or another casing conveyed perforating tool. Thus, the tool 200 may function as a casing string section, as the tool 200 may be connected in line with a casing string, in some embodiments of the invention.

The tool 200 includes fins 212 that extend along the longitudinal axis of the tool and radially extend away from the main casing body 210. In addition to receiving perforating charges (shaped charges, for example), as described below, the fins 212 form stabilizers for the tool 200 and for the casing string. Each fin 212 may include an upper beveled face 213 (FIG. 23) and a lower beveled face 215 for purposes of guiding the tool 200 through the wellbore. A perspective view of the main casing body 210 and fins 212 is shown in FIG. 26

As depicted in FIG. 24, each fin 212 includes several openings 220 (see also FIG. 26), each of which extends radially away from the longitudinal axis of the tool 200 and receives a particular perforating charge 224. Each perforating charge 224, in turn, is oriented so that the perforating charge 224 generates a perforating jet in a radial direction into the surrounding formation. In the embodiment depicted in FIGS. 23-25, the perforating charges are arranged so that four perforating charges are contained in a plane (i.e., the perforating charges of each plane are oriented 90° apart). However, in other embodiments of the invention, the perforating charges 224 may be spirally arranged around the circumference of the casing body 210 to achieve a spiral phasing for the tool 200. In these embodiments of the invention, the openings 220 may be spaced to achieve the spiral phasing. In some embodiments of the invention, the fins 212 may helically extend around the main casing body 210 to achieve the spiral phasing. Many other variations for gun phasing, fin orientation and shaped charge orientation are possible and are within the scope of the appended claims.

Each perforating charge 224 is directed in a radially outward direction from the longitudinal axis of the tool 200 so that when the perforating charge 224 fires, the charge 224 forms a perforation jet that is radially directed into the surrounding formation. Initially, before any perforating charges 224 fire, the tool 200 functions as a typical casing section in that there is no communication of well fluid through the casing wall and the central passageway. As described below, the firing of the perforating charges 224 produce communication paths between the tunnels formed by the charges 224 and the central passageway of the tool 200.

Figure 26:
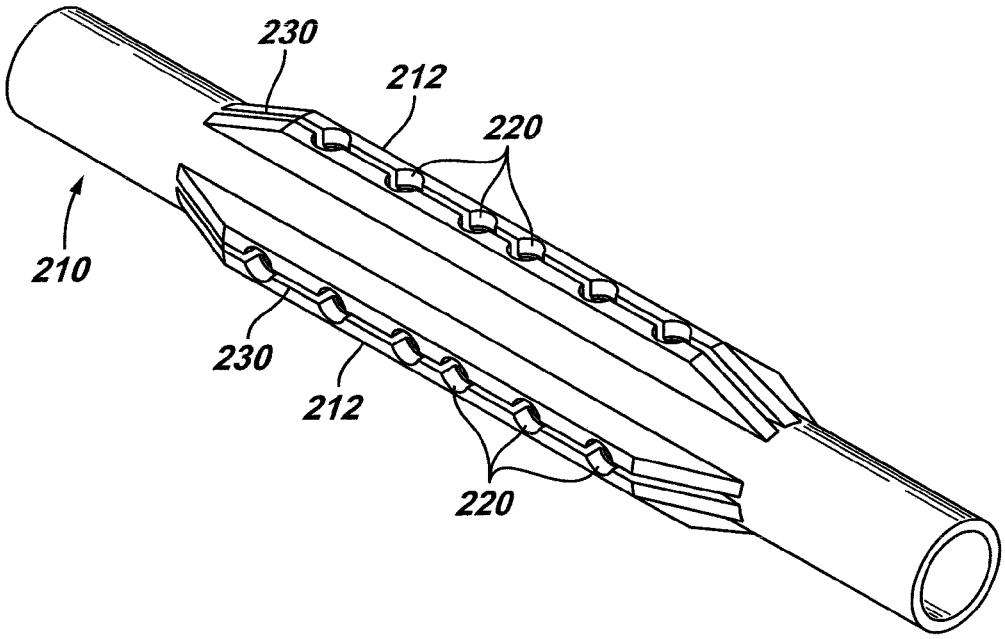
FIG. 26 depicts a main body of the casing according to an embodiment of the invention.

Referring to FIG. 26, each fin 212 includes a groove 230 that extends along the longitudinal axis of the casing and intersects each one of the openings 220 of the fin 212. This groove 230 may be used for purposes of routing a detonating cord (not shown in FIG. 26) to each of the perforating charges 220.

Figure 28:
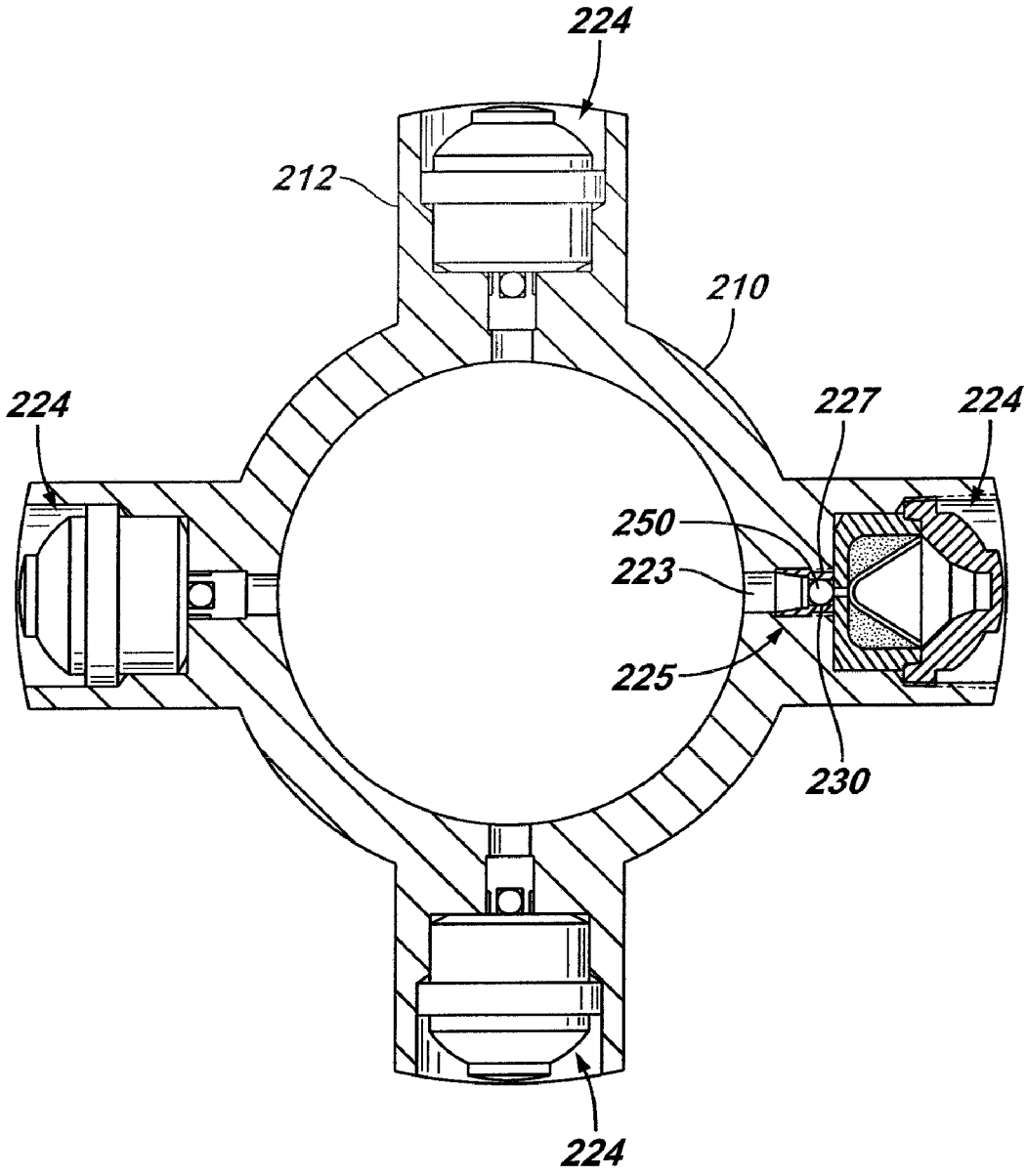
FIG. 28 depicts a cross-sectional view of the casing taking along lines 28-28 of FIG. 24 according to an embodiment of the invention.

FIG. 28 depicts a cross-section of the tool 200, in accordance with some embodiments of the invention, taken along line 28-28 of FIG. 24. As shown, each perforating charge 224 is radially disposed so that the perforation jet formed from the perforating charge 224 extends in a radial direction away from the longitudinal axis of the casing. For each perforating charge 224, the main casing body 210 includes an opening 223 that radially extends between the central passageway of the tool 200 and the opening 220 (in the fin 212) that receives the perforating charge 224. Before the perforating charge 224 fires, a plug 225 is received in the opening 223 so that the passageway wall that defines the opening 223 forms a friction fit with the plug 225.

Figure 25A:
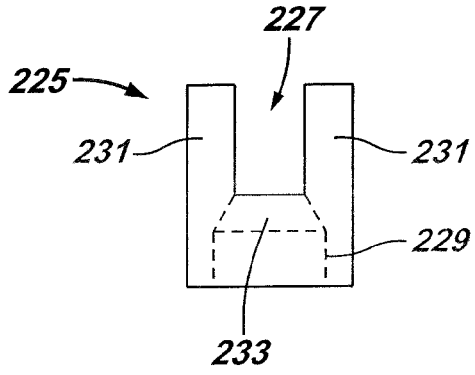
FIG. 25A is a side view of the tool of FIGS. 23, 24 and 25 according to an embodiment of the invention.
Figure 25B:
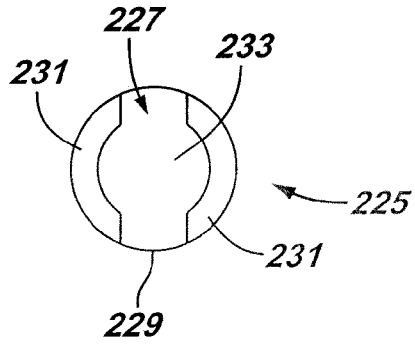
FIG. 25B is a top view of a tool according to an embodiment of the invention.

The presence of the plug 225 seals off the opening 223 so that during cementing through the central passageway of the tool 200, the cement does not enter the opening 223 and affect later operation of the perforating charge 224. Referring also to FIG. 25A (a top view of the plug 225) and 25B (a side view of the plug 225), in some embodiments of the invention, the plug 225 includes side walls 231 that form a slot 227 to receive a detonating cord 250 that is received in the groove 230 (see also FIG. 26). The side walls 231 extend from a cylindrical base, a portion of which forms a rupture disk 233. The rupture disk 233 contacts the detonating cord 250. Therefore, when a detonation wave propagates along the detonating cord 250, the detonation wave serves the dual function of rupturing the rupture disk 233 and firing the perforating charge.

Thus, the firing of each perforating charge 224 creates a tunnel into the formation and an opening through what remains of the perforating charge 224. The rupturing of the rupture disk 233 creates an opening through the plug 225 to establish well fluid communication between the formation and central passageway of the tool 200 via the opening 233.

Therefore, after the perforating charges 224 of the tool 200 fire, the tool 200 transitions into a production casing, in that well fluid is produced through the openings 233.

Figure 27:
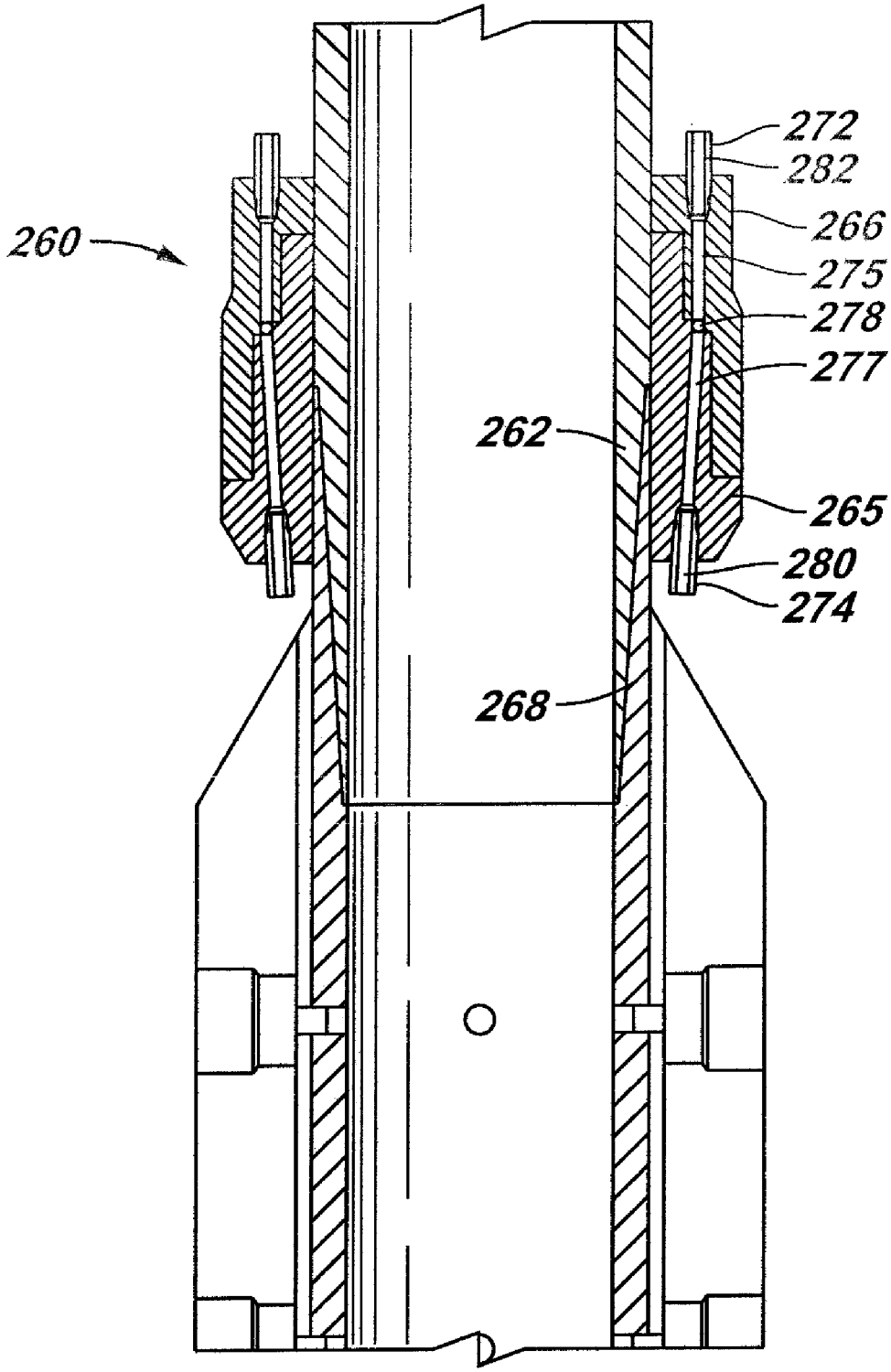
FIG. 27 depicts a ballistic junction according to an embodiment of the invention.

Referring to FIG. 27, in some embodiments of the invention, the tool 200 may be ballistically connected to an adjacent tool via a ballistic junction 260. In the embodiment depicted in FIG. 27, the junction 260 is attached to a lower end 262 of a particular tool 200 and located near an upper end 268 of an adjacent tool 200. The lower 262 and upper 268 ends may be threadably connected together for purposes of attaching the two tools 200 together.

The ballistic junction 260 includes an inner collar 265 that is attached (via threads or welds, for example) to the lower end 262 of the upper tool 200. An outer collar 266 is threaded onto the inner collar 265. The ballistic junction 260 has the following structure for each detonating cord that is longitudinally coupled through the junction 260. The structure includes an opening in inner collar 265, an opening that receives a hydraulic seal fitting nut 274. The nut 274 receives and secures a lower detonator 280 to the inner collar 265. The lower detonator 280, in turn, is connected to a detonating cord that extends from the detonator 280 into one of the fins 212 of the lower tool 200. The outer collar 266 includes an opening that receives a hydraulic seal fitting nut 272. The nut 272 receives and secures an upper detonator 282 to the outer collar 266. The upper detonator 282, in turn, is connected to a jumper detonating cord that extends from the detonator 282 into one of the fins 212 of the upper tool 200. The jumper detonating cords make the ballistic connection across the threaded casing joint, and are installed after the casing joint is made up, in some embodiments of the invention.

For each detonating cord that is longitudinally coupled through the junction 260, the ballistic junction 260 includes a detonating cord 277 that longitudinally extends from the lower detonator 274 to a detonating cord 278; and a detonating cord 275 that longitudinally extends from the upper detonator 272 to the detonating cord 278. Thus, due to this arrangement, a detonation wave propagating along either detonating cord 275 or 277 is relayed to the other cord. The detonating cord 278 extends circumferentially around the tool 200 and serves as a redundant detonating cord to ensure that an incoming detonation received on one side of the junction 160 is relayed to all detonating cords on the other side of the ballistic junction 160.

Figure 29:
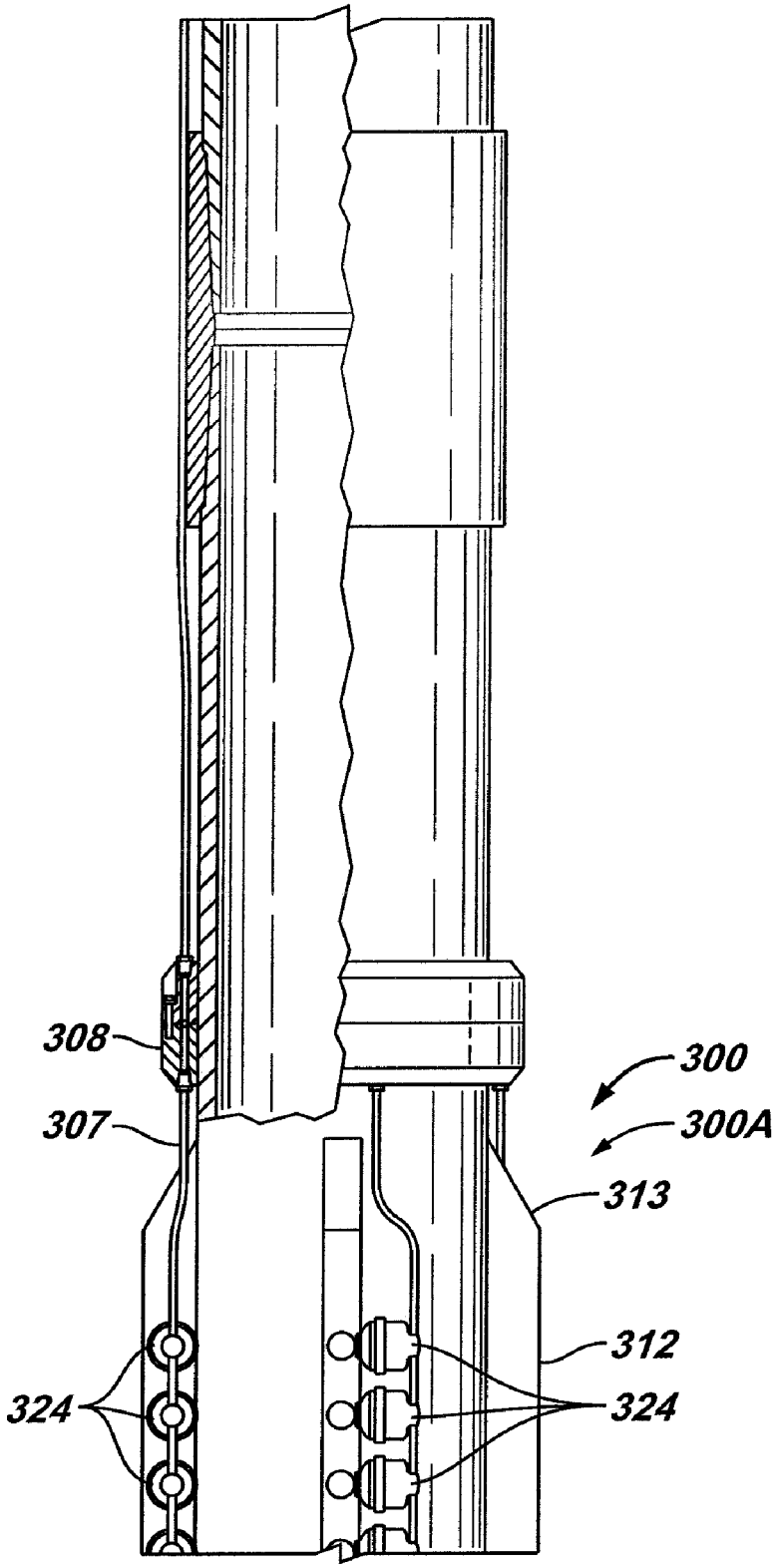
FIGS. 29 and 30 depict a casing conveyed tool according to another embodiment of the invention.
Figure 30:
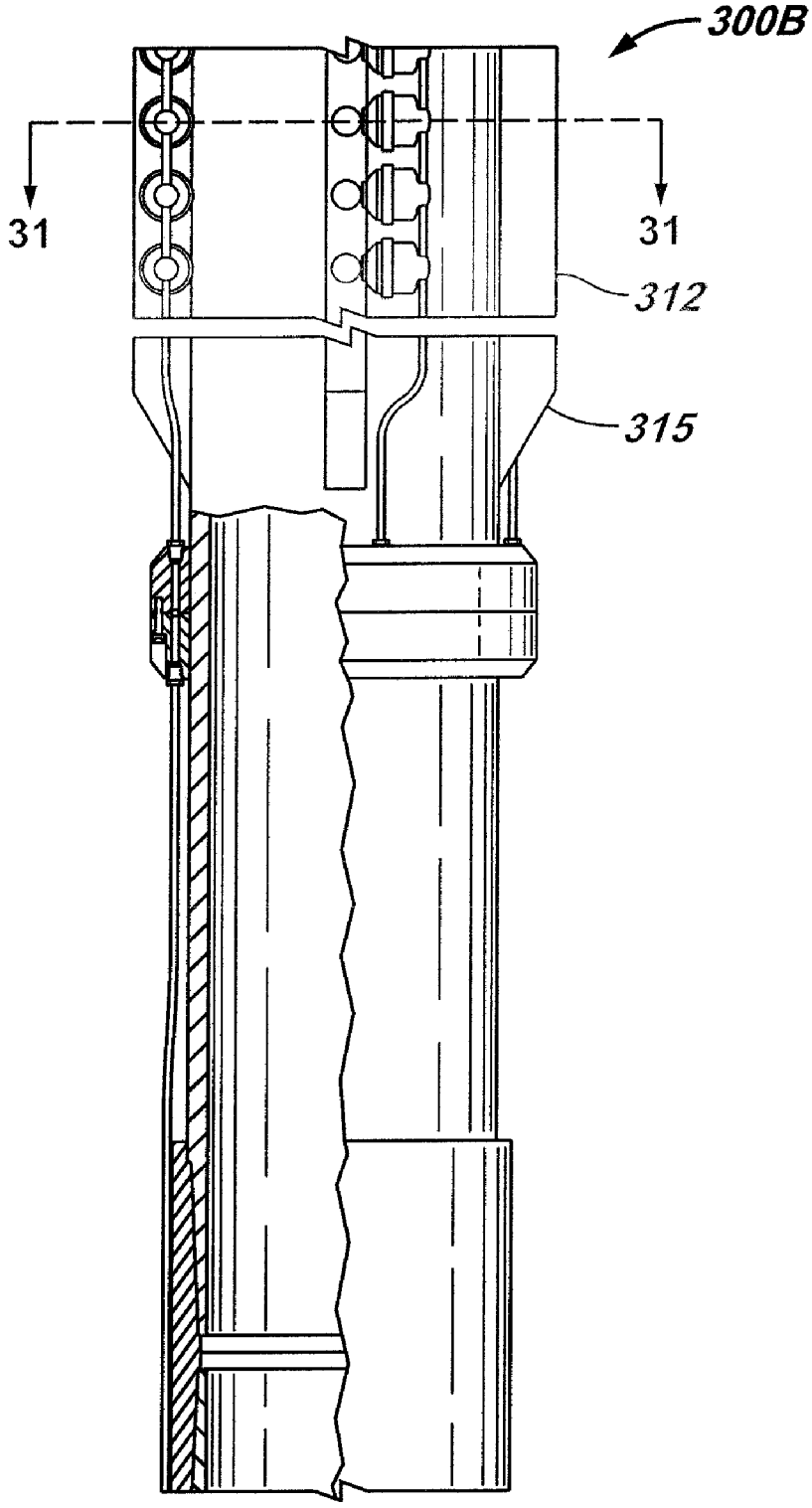

Other variations are possible for the casing conveyed perforating tool. For example, FIGS. 29 and 30 depict upper 300A and lower 300B sections of another perforating tool 300 in accordance with the invention. Unlike the casing conveyed perforating tool 200, the tool 300 includes perforating charges (shaped charges, for example) that are oriented to fire tangentially to the longitudinal axis of the tool 300. This is in contrast to the tool 200 in which the perforating charges fire radially with respect to the longitudinal axis of the tool 200.

As depicted in FIGS. 29 and 30, each perforating charge 32 is connected to the side wall of a corresponding fin 312. Similar to the tool 200, the fins 312 serve as a stabilizer for the casing string. Furthermore, each fin 312 includes upper 313 and lower 315 beveled surfaces, similar to the tool 200.

Unlike the tool 200, the perforating charges 324 of the tool 300 are directed so that the perforation jet from the perforating charges 324 are directed through the fin 312 to which the perforating charges 312 are attached. As depicted in FIGS. 29 and 30, the tool 300 includes detonating cords 307, each of which is associated with a particular fin 312. As shown, each detonating cord 307 is routed along a corresponding fin 312 and through the associated perforating charges 324 of the fin 312.

Figure 31:
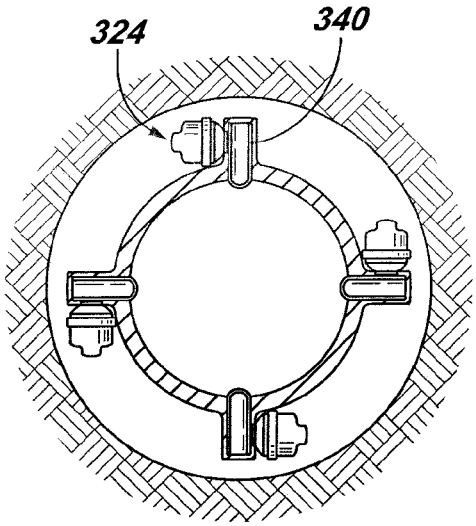
FIG. 31 is a cross-sectional view of the tool taken along line 31-31 of FIG. 30.

FIG. 31 depicts a cross-sectional view of the tool 300, taken along lines 31-31 of FIG. 30. As shown in this Figure, each fin 312 contains an internal passageway so that when the perforating charges 324 fire, communication is established through the fins 312 into the central passageway of the tool 300. For purposes of sealing off the internal passageways of the fins 312 before the firing of the perforating charges 324, the tool 300, in some embodiments of the invention, includes a knockout plug 340 for each associated perforating charge 324. The knockout plug 340 protrudes into the central passageway of the tool 300 so that a tool may be run downhole to break these plugs 340 after the perforating charges 324 fire. Similar to the tool 200, the tool 300 may include other features such as a ballistic junction 308, similar to the ballistic junction 260 discussed above.

In some embodiments of the invention, the tool 200 or 300 may include an orientation mechanism to allow the subsequent running of a gun string downhole inside the tool 200 or 300 in case the perforating charges of the tool do not fire. The orienting mechanism, as set forth below, ensures that the perforating charges of the subsequently run gun string are aligned between the fins of the tool 200 or 300. In other words, the perforating charges of this gun string are aligned to minimize the thickness of the casing through which the perforation jets are directed.

Figure 32:
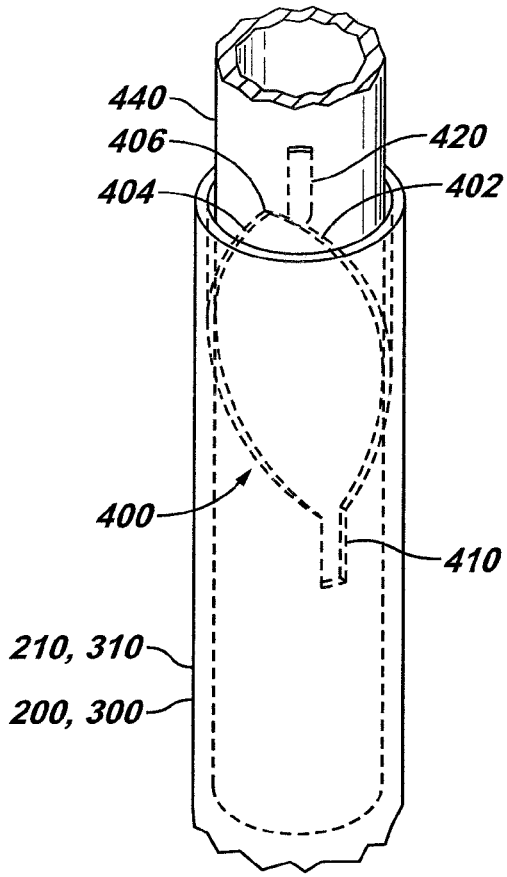
FIG. 32 is a perspective view of a gun locator mechanism according to an embodiment of the invention.

In some embodiments of the invention, this mechanism includes a key 420 on a subsequently run gun string 440. The mechanism ensures that the key 402 is aligned in a slot 410 so that when the key 420 is aligned in the slot 410, the perforating charges (not shown) of the gun string 440 perforate between the fins of the tool 200 and 300. The orienting mechanism includes an internal profile 400 located inside the main casing body 210, 310 of the tool 200, 300. The profile 400 is directed to interact with the key 420 to rotate the string 440 for purposes of aligning the key 420 in the slot 410. As depicted in FIG. 32, in some embodiments of the invention, the profile 400 may have a peak 406 located in a diametrically opposed position to the slot 410. The profile includes a first slope 404 that wraps around the interior of the gun string 440 toward the slot 410 in a first rotational direction and a slope 402 that wraps around the profile toward the slot 410 in an opposite rotational direction. Therefore, regardless of where the key 420 ends up on the profile 400, the key is always directed into the slot 410, and thus, the attached gun string 440 is rotated into the proper orientation for firing of its perforating charges.

In the preceding description, directional terms, such as "upper," "lower," "vertical," "horizontal," etc., may have been used for reasons of convenience to describe the systems and tools herein and their associated components. However, such orientations are not needed to practice the invention, and thus, other orientations are possible in other embodiments of the invention.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus comprising:

a tubular casing string comprising a casing body having a longitudinal axis and substantially extending along the entire longitudinal length of the apparatus;

an integral fin radially extending from the casing body; and a shaped perforating charge attached to the fin and oriented to generate a perforation jet in a radial direction away from the longitudinal axis of the casing body.

2. The apparatus of claim 1, wherein the fin includes a groove adapted to receive a detonating cord that is coupled to the perforating charge.

3. The apparatus of claim 1, wherein the perforating charge is adapted to permit well fluid to flow through the remnants of the perforating charge after firing of the perforating charge.

4. The apparatus of claim 1, further comprising:

a ballistic junction to couple a detonating cord extending to the perforating charge to a detonating cord extending to a perforating charge of another perforating gun.

5. The apparatus of claim 4, wherein the ballistic junction comprises:

a first sleeve adapted to receive the first detonating cord; and a second sleeve coupled to the first sleeve adapted to receive the second detonating cord.

6. The apparatus of claim 4, further comprising:

a detonating cord circumferentially disposed around the casing body to transfer charges between detonating cords of the perforating gun.

7. The apparatus claim 1, wherein the fin is one of a plurality of fins radially extending from the casing body.

8. The apparatus of claim 7, wherein the perforating charge is one of a plurality of perforating charges disposed in the fins and oriented to generate perforation jets in radial directions from the longitudinal axis of the casing body.

9. The apparatus of claim 8, wherein at least one of the perforating charges is adapted to permit well fluid to flow through the remnants of the perforating charge after firing of said at least one perforating charge.

10. The apparatus of claim 8, wherein the perforating charges are oriented in a planar phasing pattern.

11. The apparatus of claim 8, wherein the perforating charges are oriented in a spiral phasing pattern.

12. The apparatus of claim 7, wherein each of the fins includes a groove adapted to receive a detonating cord.

13. The apparatus of claim 1, wherein the casing string is adapted to line at least part of a wellbore.

14. The apparatus of claim 1, wherein the casing string is adapted to support a wellbore.

15. The apparatus of claim 1, wherein the casing string is adapted to receive completion equipment.

16. The apparatus of claim 1, wherein the casing string is cemented in place in the well.

17. The apparatus of claim 1, wherein the fin extends away from the casing body in a direction that is substantially orthogonal to the longitudinal axis.

18. A method usable with a well comprising:

forming a section of a tubular casing string, the casing string comprising a casing body having a longitudinal axis and the casing body substantially extending along the entire longitudinal length of the casing string;

forming an outer integral fin on the section; and attaching a shaped perforating charge to the fin, the perforating charge being oriented to generate a perforation jet in a radial direction away from the longitudinal axis of the casing body.

19. The method of claim 18, further comprising:

forming a groove in the fin to receive a detonating cord.

20. The method of claim 18, further comprising:

flowing well fluid through the remnants of the perforating charge after firing of the perforating charge.

21. The method of claim 18, further comprising:

ballistically coupling the perforating charge to another perforating charge of an adjacent casing section.

22. The method of claim 18, further comprising:

forming at least one additional outer fin on the casing section.

23. The method of claim 22, further comprising:

attaching at least one additional perforating charge to said at least one additional outer fin.

24. The method of claim 23, further comprising:

flowing well fluid through the remnants of the perforating charges after firing of the perforating charge.

25. The method of claim 22, further comprising:

forming at least one additional groove in said at least one additional outer fin to receive a detonating cord.

26. The method of claim 18, further comprising:
lining at least part of a wellbore with the casing string.

27. The method of claim 18, further comprising:
supporting at least part of a wellbore with the casing string.

28. A perforating gun comprising:
a casing body comprising a longitudinal axis;
a fin radially extending from the casing body;
a perforating charge attached to the fin and oriented to generate a perforation jet in a radial direction away from the longitudinal axis of the casing body; and
a plug to seal a passageway in the casing body, the plug adapted to rupture in response to the perforating charge firing to open communication through the casing body.

29. The perforating gun of claim 28, wherein the fin includes a groove adapted to receive a detonating cord that is coupled to the perforating charge.

30. The perforating gun of claim 28, wherein the perforating charge is adapted to permit well fluid to flow through the remnants of the perforating charge after firing of the perforating charge.

31. The perforating gun of claim 28, further comprising:
a ballistic junction to couple a detonating cord extending to the perforating charge to a detonating cord extending to a perforating charge of another perforating gun.

32. The perforating gun of claim 31, wherein the ballistic junction comprises:
a first sleeve adapted to receive the first detonating cord; and
a second sleeve coupled to the first sleeve adapted to receive the second detonating cord.

33. The perforating gun of claim 28, further comprising:
a detonating cord circumferentially disposed around the casing body to transfer charges between detonating cords of the perforating gun.

34. A method usable with a subterranean well comprising:
forming a section of a casing string to be inserted into a subterranean well;
forming an outer fin on the casing section;
attaching a perforating charge to the fin, the perforating charge being oriented to generate a perforation jet in a radial direction away from a longitudinal axis of the casing body; and
inserting a plug into a passageway of the casing body, the plug adapted to rupture in response to the perforating charge firing to open communication through the casing body.

35. The method of claim 34, further comprising:
forming at least one additional outer fin on the casing section.

36. The method of claim 35, further comprising:
attaching at least one additional perforating charge to said at least one additional outer fin.

37. The method of claim 34, further comprising:
flowing well fluid through the remnants of the perforating charges after firing of the perforating charge.

* * * * *